US012075919B2

(12) United States Patent
Fulbright et al.

(10) Patent No.: US 12,075,919 B2
(45) Date of Patent: Sep. 3, 2024

(54) FOLDABLE CHAIR WITH RECLINING AND SWIVELING CAPABILITIES

(71) Applicant: Dick's Sporting Goods, Inc., Coraopolis, PA (US)

(72) Inventors: Robert James Fulbright, Pittsburgh, PA (US); Anthony Joseph Koch, McKees Rocks, PA (US); Craig Francis Hofmann, Pittsburgh, PA (US); Chinawut Paesang, Sewickley, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 272 days.

(21) Appl. No.: 17/351,640

(22) Filed: Jun. 18, 2021

(65) Prior Publication Data

US 2022/0039556 A1 Feb. 10, 2022

Related U.S. Application Data

(60) Provisional application No. 63/041,175, filed on Jun. 19, 2020.

(51) Int. Cl.

| | |
|---|---|
| ***A47C 4/28*** | (2006.01) |
| ***A47C 3/025*** | (2006.01) |
| ***A47C 3/18*** | (2006.01) |
| ***A47C 7/62*** | (2006.01) |

(52) U.S. Cl.

CPC ..... *A47C 4/286* (2013.01); *A47C 3/0255* (2013.01); *A47C 3/18* (2013.01); *A47C 7/624* (2018.08)

(58) Field of Classification Search

CPC ..... A47C 4/286; A47C 3/0255; A47C 3/18

See application file for complete search history.

(56) References Cited

U.S. PATENT DOCUMENTS

| | | | |
|---|---|---|---|
| 1,344,431 | A | 6/1920 | Albertie |
| 2,828,801 | A | 4/1958 | Papst |
| 4,119,343 | A | 10/1978 | Pentzien |
| 5,039,164 | A | 8/1991 | Gibbs |
| 5,599,064 | A | 2/1997 | Vanderminden |
| 5,611,594 | A | 3/1997 | Findlay |
| 7,175,232 | B2 | 2/2007 | Rivera |
| 7,841,660 | B2 | 11/2010 | Wang et al. |
| 10,070,728 | B2 | 9/2018 | Piretti |
| 10,531,739 | B2 | 1/2020 | Ostwald et al. |
| 10,874,217 | B2 | 12/2020 | Grace |
| 2010/0314926 | A1 | 12/2010 | Chesness |
| 2011/0285192 | A1 | 11/2011 | Holt et al. |
| 2012/0274107 | A1 | 11/2012 | Chesness |
| 2014/0306493 | A1 | 10/2014 | Obolewicz et al. |

(Continued)

FOREIGN PATENT DOCUMENTS

| | | | |
|---|---|---|---|
| DE | 20012517 | U1 | 2/2001 |
| WO | 00-48487 | A1 | 8/2000 |
| WO | WO-2005/055769 | A2 | 6/2005 |

*Primary Examiner* — Anthony D Barfield

(74) *Attorney, Agent, or Firm* — Foley & Lardner LLP

(57) ABSTRACT

A foldable chair includes a lower hub assembly and an upper hub assembly. The lower hub assembly has foldable legs for supporting the chair. The upper hub assembly has a plurality of bars, and webbing mounted on the bars. The bars are movable so that the webbing can be folded and unfolded. The webbing provides a seating area when unfolded. The chair also includes a center shaft assembly that facilitates tilting and swiveling of the seating area in relation to the lower hub assembly.

19 Claims, 39 Drawing Sheets

(56) References Cited

U.S. PATENT DOCUMENTS

| | | | |
|---|---|---|---|
| 2019/0029429 | A1 | 1/2019 | Browning et al. |
| 2022/0175141 | A1 | 6/2022 | Zhu |
| 2022/0225773 | A1 | 7/2022 | Sun et al. |

FOLDABLE CHAIR WITH RECLINING AND SWIVELING CAPABILITIES

CROSS-REFERENCE TO RELATED APPLICATIONS

This application claims the benefit under 35 U.S.C 119(e) of U.S. provisional application No. 63/041,175, filed Jun. 19, 2020, the contents of which are incorporated by reference herein in their entirety.

BACKGROUND

Foldable chairs are used on a widespread basis to provide a convenient, portable means of seating at sporting events, campgrounds, picnics, etc. Foldable chairs typically include a rigid frame, and a flexible webbing or skin attached to the frame. The frame is configured to translate between a compact, folded state and an expanded, unfolded state. The flexible webbing folds and unfolds along with the frame, is supported by the frame, and provides the seating area for the user when the chair is unfolded.

User comfort can be enhanced by providing the user with the option to tilt or recline the seating area of the foldable chair. User comfort and convenience also can be enhanced by providing the user with the ability to rotate, or swivel the seating area to face a desired direction, without a need for the user to stand up, and then lift and move the entire chair.

Because foldable chairs are supported by a lightweight, foldable frame that is not anchored to the ground or other supporting surface, foldable chairs typically are less stable than heavier, non-foldable chairs. This lower stability can subject users to a tipping hazard and other safety issues.

While enhanced stability, and the ability to recline and swivel are desirable features in a foldable chair, providing these features while maintaining the lightweight, compact, and portable nature of the foldable chair presents substantial challenges.

SUMMARY

In one aspect of the disclosed technology, a foldable chair includes a lower hub assembly having a hub, and a plurality of legs coupled to the hub and configured to rotate in relation to the hub. The foldable chair also includes a center shaft assembly mounted on the hub and configured to rotate in relation to the lower hub assembly. The foldable chair further includes an upper hub assembly having a plurality of bars coupled to the center shaft assembly and configured to rotate in relation to the center shaft assembly, and a webbing mounted on the bars. The webbing is configured to fold and unfold as the bars rotate in relation to the center shaft assembly, and to form a seating area when the webbing is unfolded.

In another aspect of the disclosed technology, the center shaft assembly includes a first plate, and a shaft secured to the first plate. The hub has a passage formed therein, and the shaft is positioned in the passage.

In another aspect of the disclosed technology, the hub includes a contact surface, and the first plate is configured to slide on the contact surface as the center shaft assembly rotates in relation to the lower hub assembly.

In another aspect of the disclosed technology, the center shaft assembly further includes a second plate coupled to the first plate and configured to rotate in relation to the first plate, and the upper hub assembly is mounted on the second plate.

In another aspect of the disclosed technology, the center shaft assembly further includes a spring positioned between the first and second plates.

In another aspect of the disclosed technology, the second plate is configured to rotate between a first and a second angular position in relation to the first plate, and the spring is configured to bias the second plate toward the first angular position.

In another aspect of the disclosed technology, the seating area is substantially level in relation to the ground when the second plate is in the first angular position and the legs of the lower hub assembly are resting on the ground.

In another aspect of the disclosed technology, the spring is a first spring, and the center shaft assembly further includes a second spring positioned between the first and second plates. The first spring is a compression spring, and the second spring is an extension spring. The second spring is configured to bias the second plate toward the first angular position.

In another aspect of the disclosed technology, the second plate is configured to rotate in relation to the first plate about an axis of rotation, and the first and second springs are positioned on opposite sides of the axis of rotation.

In another aspect of the disclosed technology, the second plate is configured to rotate in relation to the first plate about an axis of rotation, and a center axis of the torsion spring is substantially coincident with the axis of rotation.

In another aspect of the disclosed technology, the upper hub assembly further includes a center support and a plurality of links; and each of the links is coupled to, and is configured to rotate in relation to the center support and one of the bars. The center support is configured to engage the center shaft assembly when the webbing is unfolded; and the center support and the links are further configured to restrain the upper hub assembly in relation to the center shaft assembly when the center support engages the center shaft assembly.

In another aspect of the disclosed technology, the center shaft assembly incudes a support lock having a cavity configured to receive a body of the center support when the webbing is unfolded.

In another aspect of the disclosed technology, the first plate includes a substantially planar major portion, and two flanges that adjoin, and extend from the major portion; and the second plate includes a substantially planar major portion, and two flanges that adjoin, and extend from the major portion of the second plate. The center shaft assembly further includes a pin extending through the flanges of the first and scone plates; and the pin is configured to couple the first and second plates.

In another aspect of the disclosed technology, the first or the second plate further includes tabs that extend from the flanges of the first or the second plate; and the tabs are configured limit the rotation of the second plate in relation to the first plate.

In another aspect of the disclosed technology, the tabs are further configured limit the rotation of the second plate in relation to the first plate to rotation of the second plate between the first and the second angular positions of the second plate.

In another aspect of the disclosed technology, the center shaft assembly further comprises a plurality of u-plates mounted on the second pate; and each of the brackets is coupled to the second plate by way of a respective one of the u-plates.

In another aspect of the disclosed technology, the center shaft assembly further includes a lock configured to secure the bars in an unfolded configuration.

In another aspect of the disclosed technology, the lock includes a pin, and a pin housing. The pin is configured to engage the body of the center support by way of holes in the pin housing, the support lock, and the body when the body is positioned in the cavity; and the pin is further configured to retain the body in the cavity when the pin engages the body.

In another aspect of the disclosed technology, the center shaft assembly is configured to facilitate tilting and swiveling of the seating area in relation to the lower hub assembly.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1B:
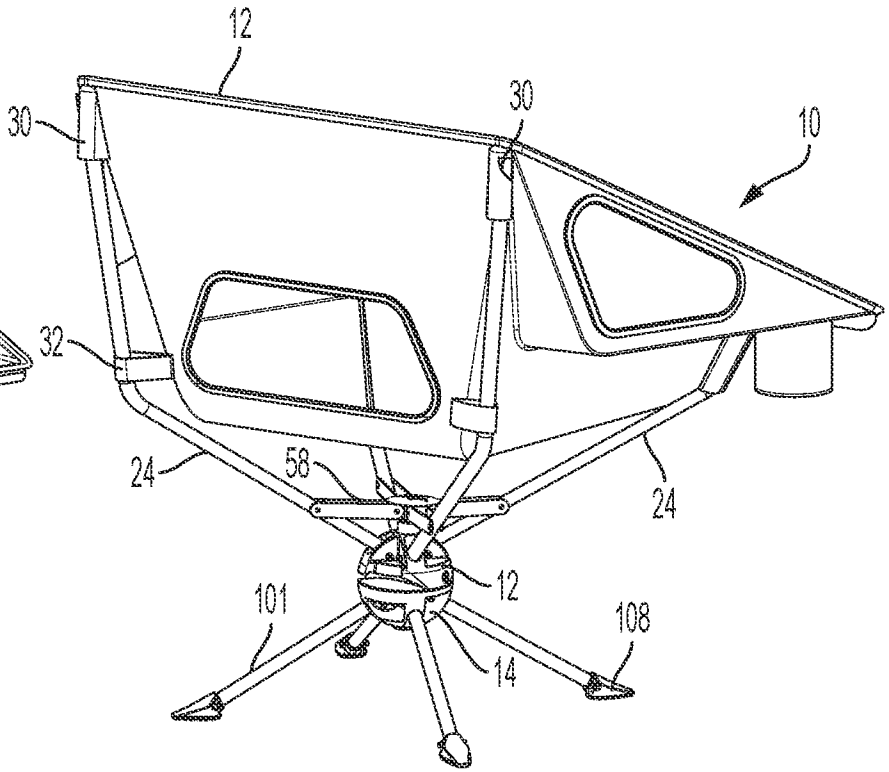
FIG. 1B is a rear perspective view of the chair shown in FIG. 1A, depicting the chair in the unfolded, non-reclined state.
Figure 1A:
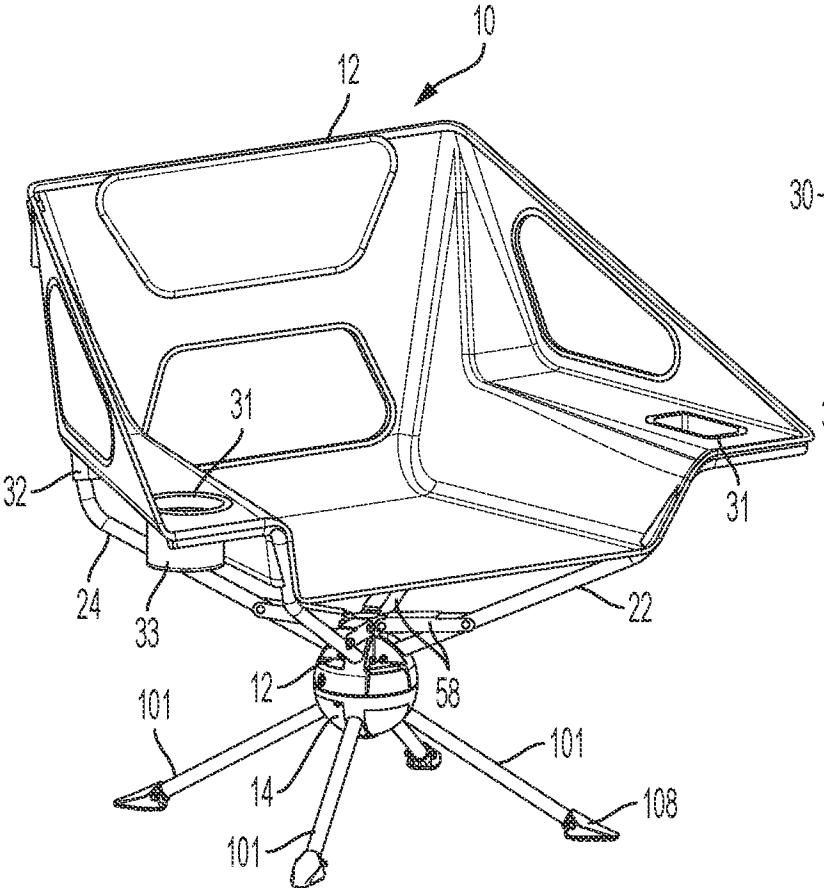
FIG. 1A is a front perspective view of a foldable chair with reclining and swiveling capabilities, depicting the chair in an unfolded, non-reclined state.
Figure 2B:
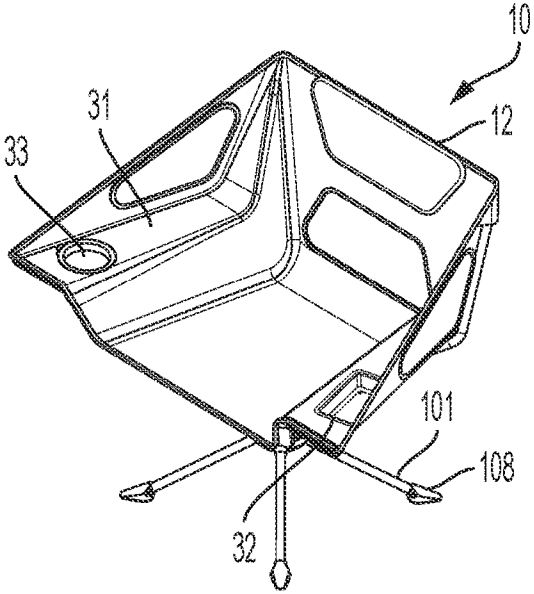
FIG. 2B is a bottom-rear perspective view of the chair shown in FIGS. 1A-2A, depicting the chair in the unfolded, non-reclined state.
Figure 2D:
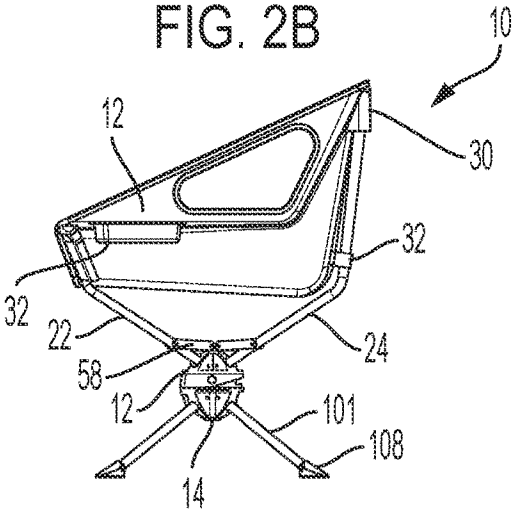
FIG. 2D is a side view of the chair shown in FIGS. 1A-2C, depicting the chair in the unfolded, non-reclined state.
Figure 2A:
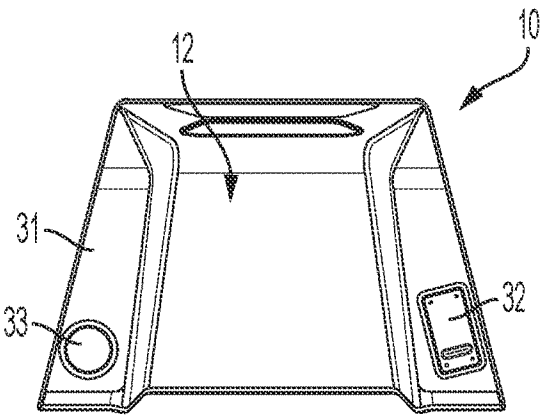
FIG. 2A is a top view of the chair shown in FIGS. 1A and 1B, depicting the chair in the unfolded, non-reclined state.
Figure 2C:
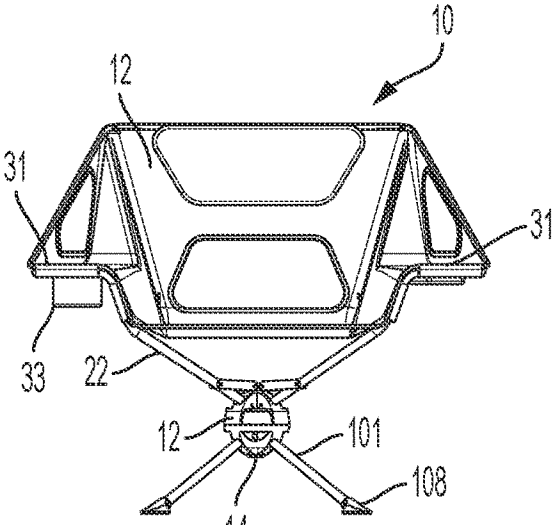
FIG. 2C is a front view of the chair shown in FIGS. 1A-2B, depicting the chair in the unfolded, non-reclined state.
Figure 2E:
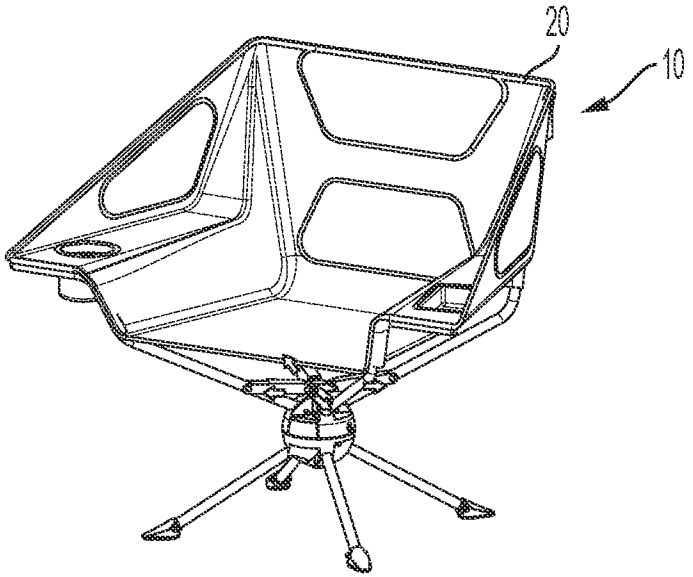
FIG. 2E is a front-right perspective view of the chair shown in FIGS. 1A-2D, depicting the chair in the unfolded, non-reclined state.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The terms "approximately" and "about" when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", "front" and "rear", or "outer" and "inner," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Figure 20B:
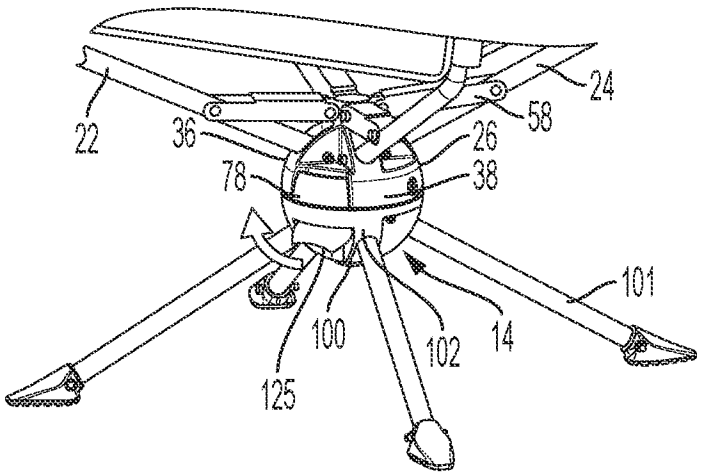
FIG. 20B is a top-side perspective view of the center shaft assembly, the portion of the upper hub assembly, and the portion of the lower hub assembly shown in FIGS. 18A-19B, depicting the chair in the unfolded, non-reclined state, with the slide lock in the locked position, and the cam lever in the unlocking position.
Figure 20C:
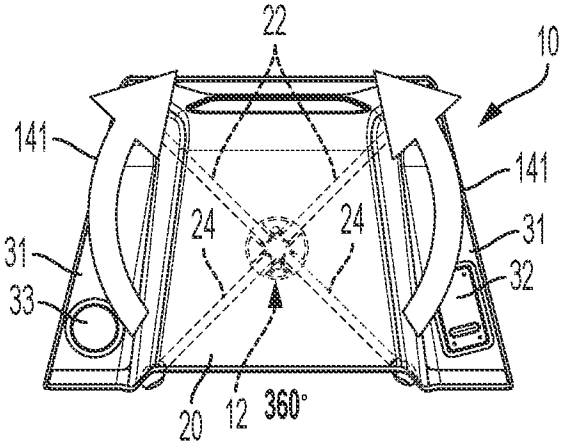
FIG. 20C is a top view of the chair shown in FIGS. 1A-4 and 20A, depicting the chair in the unfolded, non-reclined state.
Figure 20A:
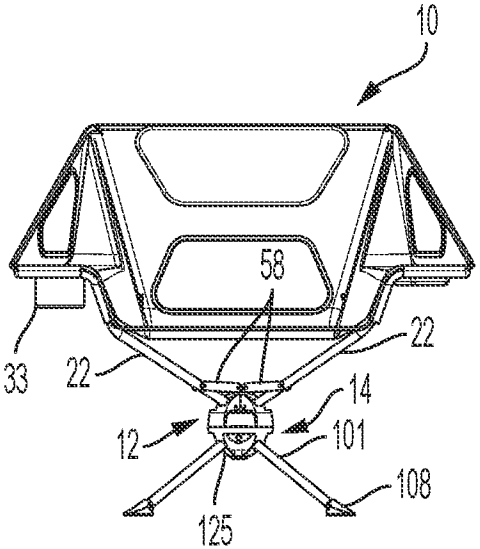
FIG. 20A is a front view of the chair shown in FIGS. 1A-4, depicting the chair in the unfolded, non-reclined state, with the slide lock in the locked position, and the cam lever in the locking position.
Figure 21B:
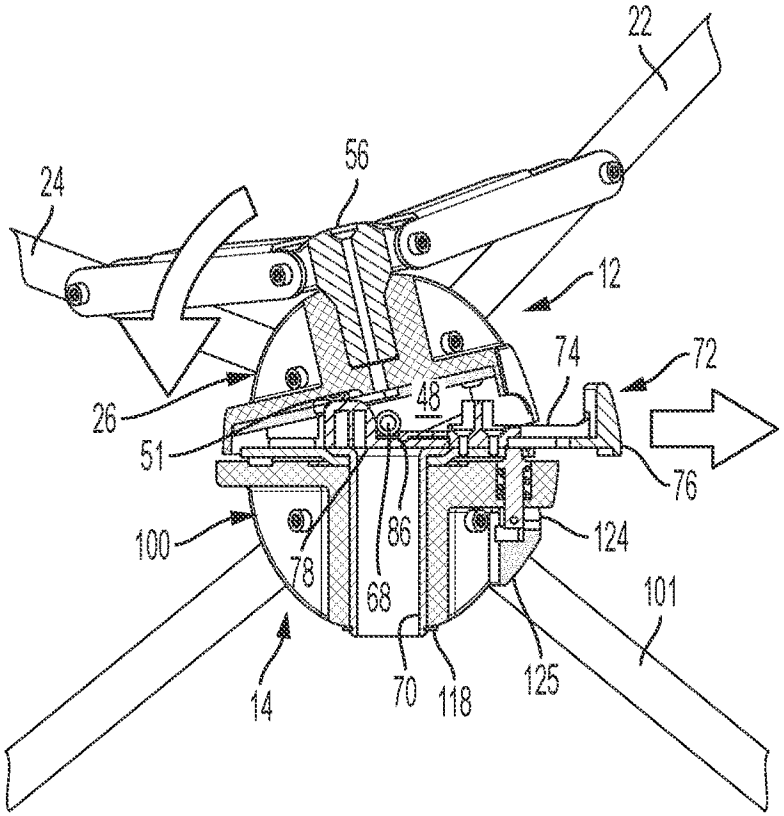
FIG. 21B is a cross-sectional view of the center shaft assembly, the portion of the upper hub assembly, and the portion of the lower hub assembly shown in FIGS. 18A-19B, 20B, and 21A, depicting the chair in the unfolded, reclined state, with the slide lock in the unlocked position, and the cam lever in the locking position.

FIGS. 1A-22D depict an example foldable chair 10, and various components thereof. The chair 10 can be folded and unfolded between a first, or folded position suitable for transport and storage of the chair 10; and a second, or unfolded position in which a user can sit in the chair 10. When unfolded, the chair 10 can be rotated or swiveled in relation to the ground into any angular, or clock position as denoted, for example, in FIG. 20C. Also, the unfolded chair 10 can be tilted or reclined, as shown in FIG. 22D.

The chair 10 includes an upper hub assembly 12, a lower hub assembly 14, and a center shaft assembly 16. The upper hub assembly 12 provides the seating area for a user. The lower hub assembly 14 contacts the ground or other supporting surface, and acts as a base that supports the remainder of the chair 10. The center shaft assembly 16 couples the upper hub assembly 12 to the lower hub assembly 14, and facilitates rotation and tilting of the upper hub assembly 12 in relation to the lower hub assembly 14. The upper hub assembly 12, lower hub assembly 14, and center shaft assembly 16 cooperate to facilitate the reclining movement of the chair 10.

Upper Hub Assembly

The upper hub assembly 12 may include a webbing or chair skin 20, two front seat bars 22, and two back seat bars 24. The upper hub assembly 12 also includes an upper hub 26, and an upper plate 28 connected to the upper hub 26.

The chair skin 20 forms the seating area for a user when the chair 10 is unfolded. The front seat bars 22 and the back seat bars 24 provide a rigid framework that supports the chair skin 20 and maintains the chair skin 20 in its unfolded shape as shown, for example, in FIGS. 1-2E, 4, 22B, 22D, 20A, and 20C. The chair skin 20 can be attached to the front seat bars 22 and back seat bars 24 by webbing 30 and webbing loops 32 attached to the chair skin 20 and shown, for example, in FIGS. 1B and 2D. The chair skin 20 is formed from a foldable, durable material such as nylon.

The front seat bars 22 and the back seat bars 24 each have a tubular configuration with a circular cross section. The front seat bars 22 and the back seat bars 24 can be solid, and can have a cross-section other than circular in alternative embodiments. The front seat bars 22 and the back seat bars 24 are formed from a rigid and durable material such as aluminum; the front seat bars 22 and the back seat bars 24 can be formed from other materials in the alternative.

Referring to FIGS. 1A-2E, the front seat bars 22, the back seat bars 24, and the chair skin 20 can be configured so that the chair 10 defines arm rests 31 when the chair 10 is unfolded. The arm rests 31 can be equipped with a tray 32 and a cup holder 33. Alternative embodiments of the chair 10 can be configured without the arm rests 31 and the cup holder 33.

The front seat bars 22 and the back seat bars 24 are coupled to the upper hub 26. The upper hub 26 has a generally hemispherical outer profile, as can be seen in FIGS. 5A-5E. The upper hub 26 may have four passages 35 formed therein. However, additional or fewer passages may be used within the scope of this disclosure. The passages 35 extend inward from an outer surface 36 of the outer hub 26, and are equally spaced around the outer perimeter of the upper hub 26. Each passage 35 receives a lower end of one of the front seat bars 22 or the back seat bars 24. The lower end of each front seat bar 22 and back seat bar 24 is coupled to the upper hub 26 by a pin, so that the front seat bars 22 and back seat bars 24 can pivot upward in relation to the upper hub 26 from the positions depicted in FIGS. 1A-2E. The pivoting movement of the front seat bars 22 and back seat bars 24 facilitates folding of the chair 10.

Figure 3B:
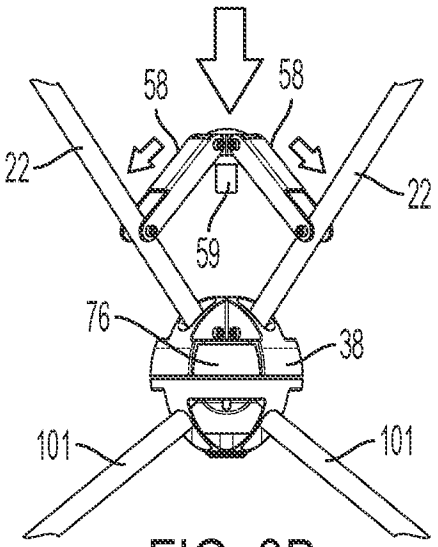
FIG. 3B is a front perspective view of the upper and lower hub assemblies shown in FIG. 3A, as the chair is being unfolded.
Figure 3A:
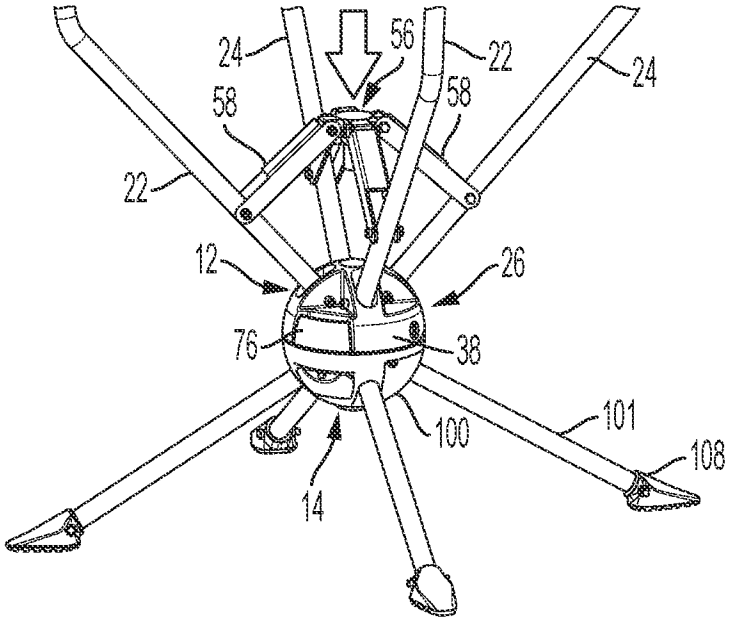
FIG. 3A is a front perspective view of a lower hub assembly and of an upper hub assembly of the chair shown in FIGS. 1A-2E, as the chair is being unfolded.
Figure 4:
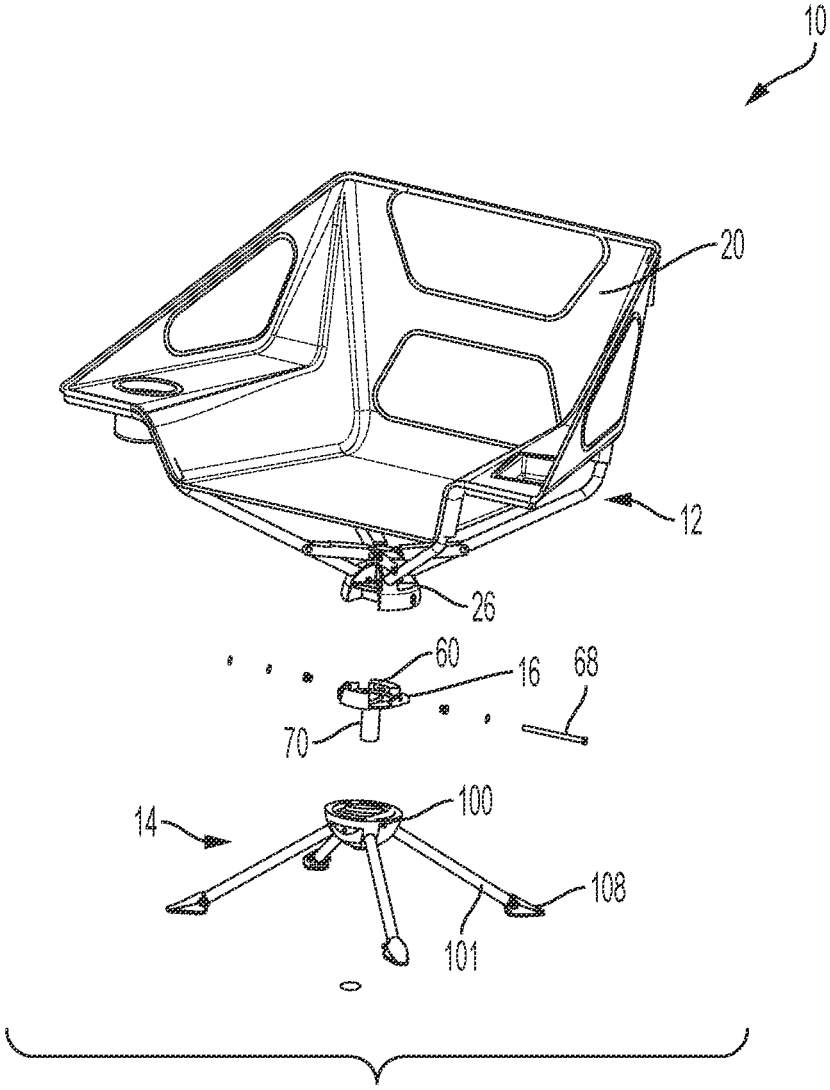
FIG. 4 is an exploded view of the chair shown in FIGS. 1A-3B.
Figure 5C:
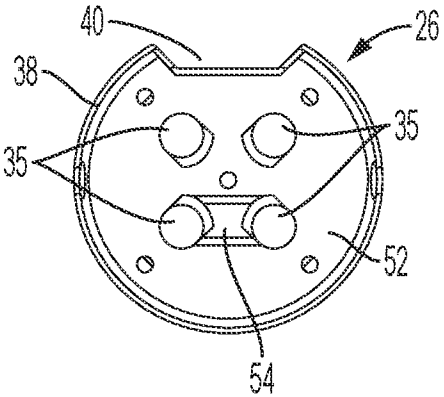
FIG. 5C is a top view of the upper hub shown in FIGS. 5A and 5B.
Figure 5B:
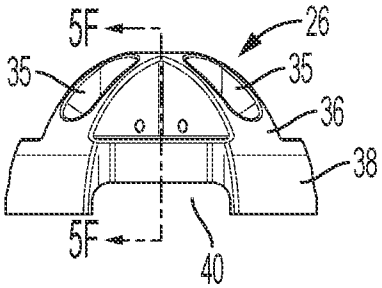
FIG. 5B is a side view of the upper hub shown in FIG. 5A.
Figure 5A:
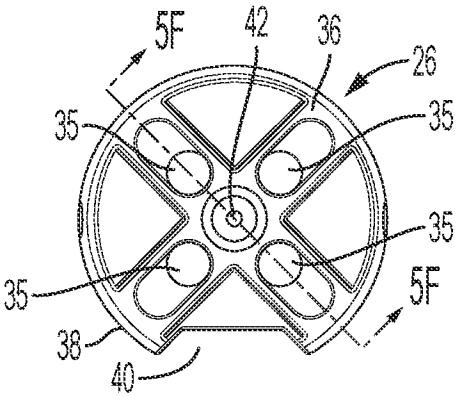
FIG. 5A is a bottom view of an upper hub of the upper hub assembly shown in FIGS. 3A and 3B.
Figure 5G:
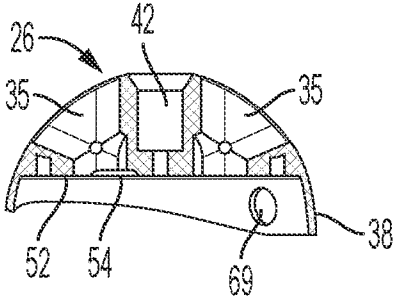
FIG. 5G is a cross-sectional view of the upper hub shown in FIGS. 5A-5F, taken through the line B-B of FIG. 5A.
Figure 5F:
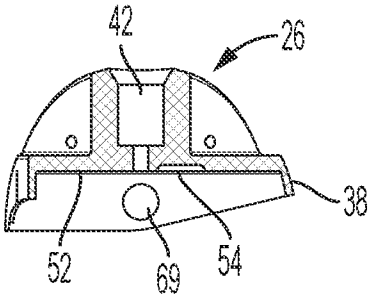
FIG. 5F is a cross-sectional view of the upper hub shown in FIGS. 5A-5E, taken through the line A-A of FIG. 5B.
Figure 5E:
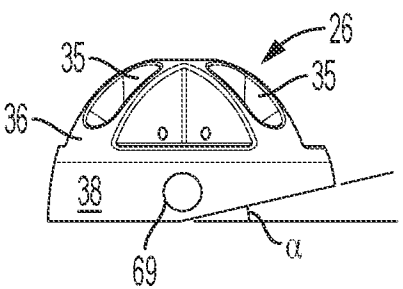
FIG. 5E is a side view of the upper hub shown in FIGS. 5A-5D.
Figure 5D:
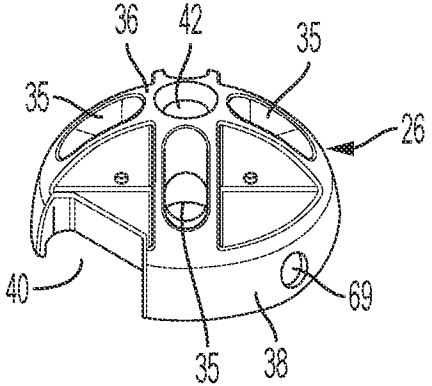
FIG. 5D is a top-side perspective view of the upper hub shown in FIGS. 5A-5C.

The upper hub 26 has a lip 38 that extends around a portion of the outer perimeter of the upper hub 26, and forms the lowermost portion of the outer hub 26, from the perspective of FIGS. 3A and 3B. A portion of the lower edge of the lip 38 is angled upward at an acute angle α, as can be seen in FIG. 5E. The angle α can be about 13 degrees; the angle α can have other values in alternative embodiments. As shown in FIG. 5D, the lip 38 is interrupted, i.e., the lip 38 does not extend around the entire periphery of the upper hub 26. A recess 40 is formed in the upper hub 26, adjacent the interruption in the lip 38.

The upper hub 26 has a centrally-located cavity 42 formed therein. The cavity 42 is substantially cylindrical, and extends along the vertical centerline of the upper hub 26, from the perspective of FIGS. 5F and 5G. The uppermost portion of the cavity 42 is inwardly tapered, i.e., the uppermost portion of the cavity 42 decreases in diameter as it extends downward from the outer surface 36 of the upper hub 26.

Figure 6B:
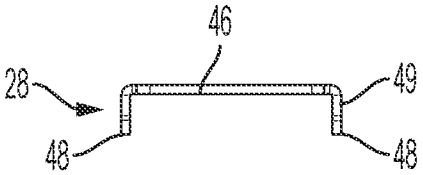
FIG. 6B is a front view of the upper plate shown in FIG. 6A.
Figure 6D:
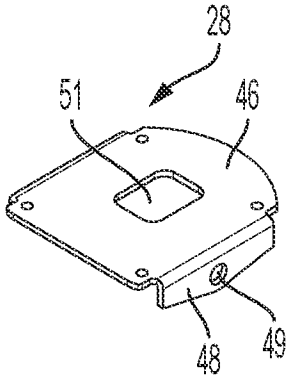
FIG. 6D is a top-front perspective view of the upper plate shown in FIGS. 6A-6C.
Figure 6E:
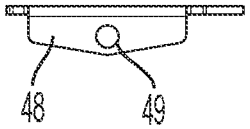
FIG. 6E is a front view of the upper plate shown in FIGS. 6A-6D.
Figure 6A:
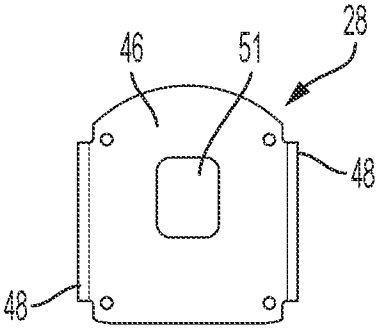
FIG. 6A is a top view of an upper plate of the upper hub assembly shown in FIGS. 3A and 3B.
Figure 6C:
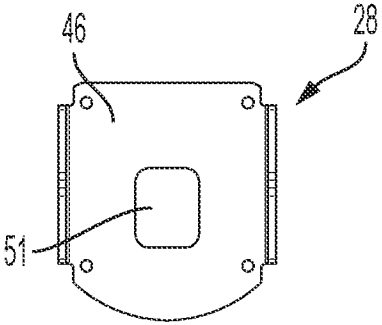
FIG. 6C is a bottom view of the upper plate shown in FIGS. 6A and 6B.
Figure 8B:
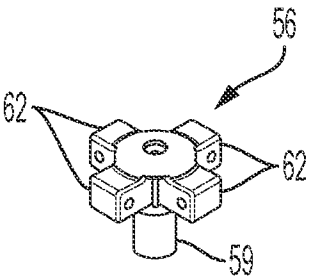
FIG. 8B is a top-front perspective view of the center support shown in FIG. 8A.
Figure 8E:
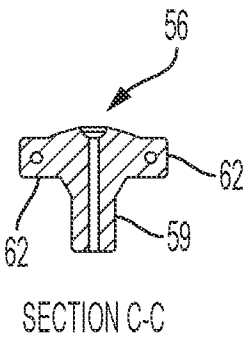
FIG. 8E is a cross-sectional view of the center support shown in FIGS. 8A-8D, taken through the line C-C of FIG. 8D.
Figure 8D:
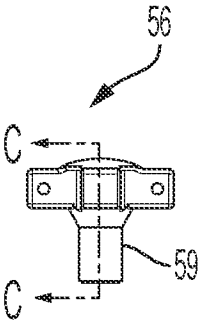
FIG. 8D is another side view of the center support shown in FIGS. 8A-8C, from a perspective rotated 90 degrees from the perspective of FIG. 8C.
Figure 8A:
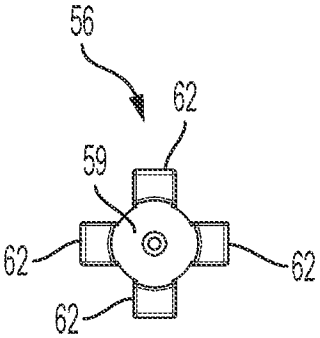
FIG. 8A is a top view of a center support of the upper hub assembly shown in FIGS. 3A and 3B.
Figure 8C:
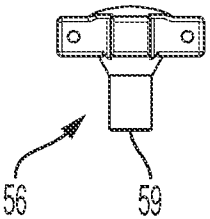
FIG. 8C is a side view of the center support shown in FIGS. 8A and 8B.
Figure 7B:
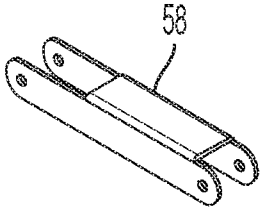
FIG. 7B is a side view of the link shown in FIG. 7A.
Figure 7D:
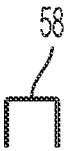
FIG. 7D is a front view of the link shown in FIGS. 7A-7C.
Figure 7A:
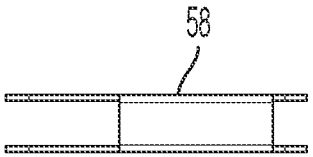
FIG. 7A is a top view of a link of the upper hub assembly shown in FIGS. 3A and 3B.
Figure 7C:
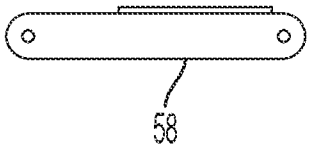
FIG. 7C is a top-front perspective view of the link shown in FIGS. 7A and 7B.

Referring to FIGS. 6A-6E, the upper plate 28 has a substantially planar major portion 46; and two flanges 48 that adjoin, and extend downward upward from opposite ends of the major portion 46 from the perspective of FIG. 6B. The major portion 46 and the flanges 48 are unitarily formed; the major portion 46 and the flanges 48 can be formed separately, and can be connected by a suitable means such as welding in alternative embodiments. Each flange 48 has a through hole 49 formed therein at the approximate center of the flange 48. A rectangular opening 51 is formed in the major portion 46.

The major portion 46 of the upper plate 28 is securely attached to a lower surface 52 of the upper hub 26. The lower surface 52 is depicted in FIG. 5C. The lower surface 52 is substantially planar, and faces downward from the perspective of FIGS. 5F and 5G. The lower surface 52 has a recess 54 formed therein. The recess 54 is located directly above the opening 51 in the upper plate 28.

The upper hub assembly 12 further includes a center support 56, and four links 58. As shown in FIGS. 8A-8E, the center support 56 includes a body 59, and four flanges 62 that extend from the body 59. Each flange 62 is angularly spaced from its adjacent flanges 62 by about 90 degrees.

Each flange 62 is coupled to a first end of a corresponding one of the links 58 by a pin or other suitable means that permits the link 58 to pivot in relation to the flange 62, as can be seen for example in FIGS. 22A-22D. A second end of each link 58 likewise is coupled to one of the front seat bars 22 or the back seat bars 24 by a pin or other suitable means that permits the link 58 to pivot in relation to its associated front seat bar 22 or back seat bar 24.

Figure 18B:
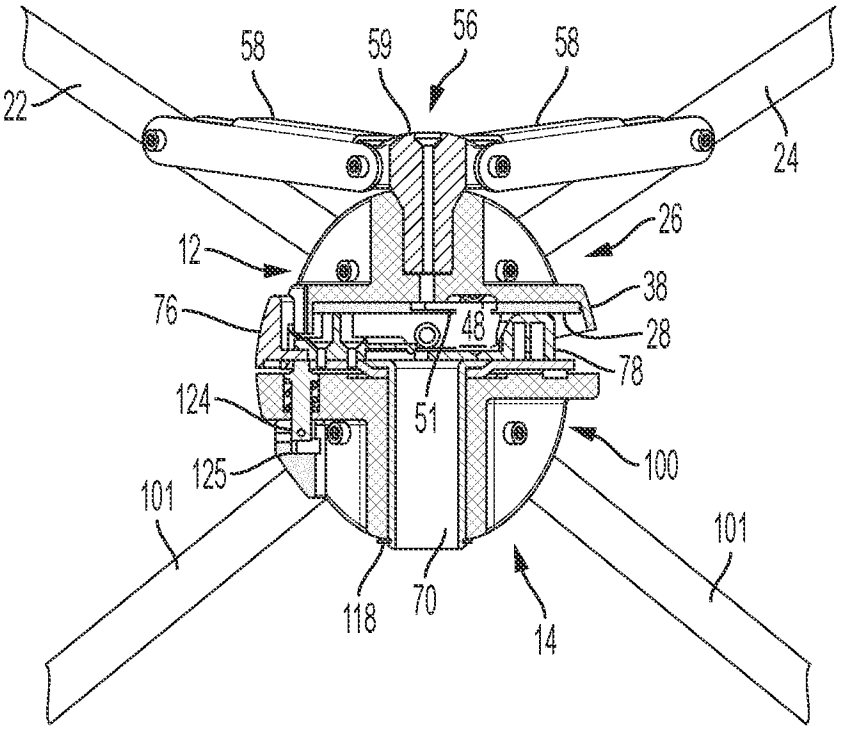
FIG. 18B is a cross-sectional view of the center shaft assembly, the portion of the upper hub assembly, and the portion of the lower hub assembly shown in FIG. 18A, depicting the chair in the unfolded, non-reclined state, with the slide lock in the locked position, and the cam lever in the locking position.

As shown in FIG. 18B, the body 59 has a shape and dimensions about the same as those of the cavity 42 of the upper hub 26, so that the body 59 fits within the cavity 42 with minimal clearance. The center support 56, the links 58, the front seat bar 22, and the back seat bar 24 are configured cooperate so that the body 59 of the center support 56 becomes disposed in the cavity 42 when the chair 10 is in its unfolded state; and the body 59 is lifted out of the cavity 42 when as chair 10 is folded. In particular, the center support 56, the links 58, the front seat bars 22, and the back seat bars 24 are kinematically configured so that the links 58 have a nearly horizontal orientation and the body 59 is disposed in the cavity 42 of the upper hub 26 when the chair 10 is in its unfolded state as shown in FIG. 18B. The upper hub 26 thereby exerts a stabilizing effect on the front seat bars 22 and the back seat bars 24, and the attached chair skin 20, by way of the center support 56 and the links 58.

Figure 18A:
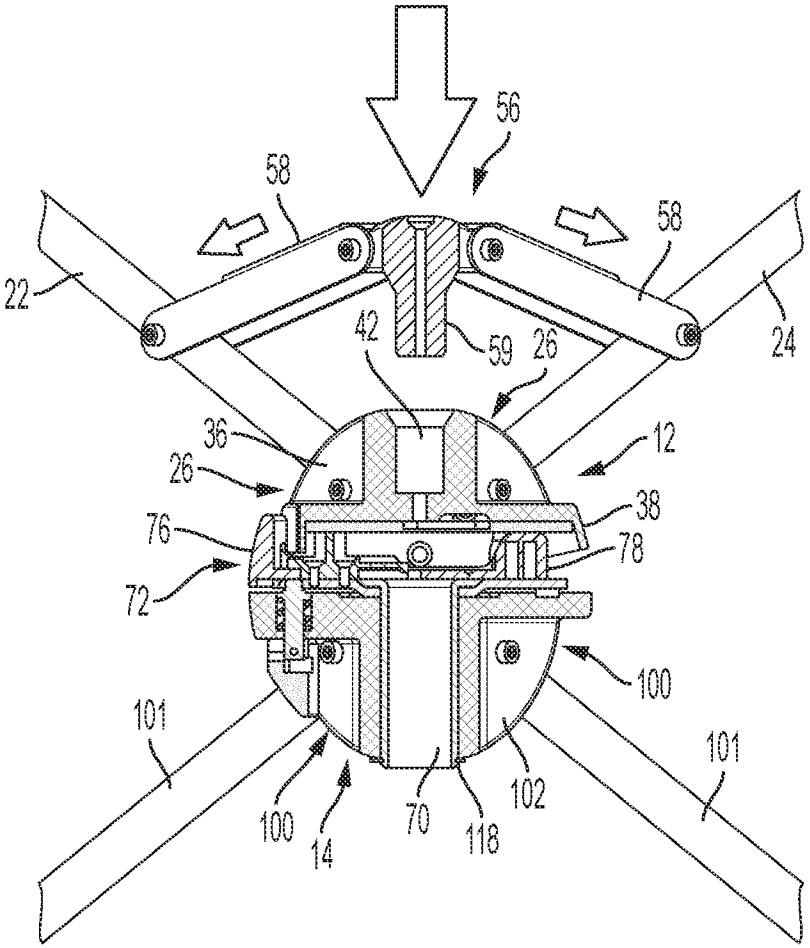
FIG. 18A is a cross-sectional view of the center shaft assembly, a portion of the upper hub assembly, and a portion of the lower hub assembly of the chair show in FIGS. 1A-4, as the chair is being unfolded, with the slide lock of the lower hub assembly in a locked position, and a cam lever of the lower hub assembly in a locking position.

The chair 10 is folded by moving the front seat bars 22 and the back seat bars 24 toward each other, so that the front seat bars 22 and the back seat bars 24 pivot about their respective attachment points to the upper hub 26. The movement of the front seat bars 22 and the back seat bars 24 causes the links 58 to pivot so that the first ends of the links 58, i.e., the ends of the links 58 coupled to the center support 56, rise upward, which in turn moves the body 59 up and out of the cavity 42 as shown in FIG. 18A. This decoupling of the center support 56 and the upper hub 26 allows the front seat bars 22 and the back seat bars 24 to be drawn even closer to each other, until the chair 10 reaches its folded state. When the chair 10 subsequently is unfolded, the kinematic relationship between the center support 56, the links 58, the front seat bars 22, and the back seat bars 24 causes the body 59 of the center support 56 to return automatically to its position within the cavity 42.

Center Shaft Assembly

As noted above, the center shaft assembly 16 couples the upper hub assembly 12 to the lower hub assembly 14, and facilitates rotation, or swiveling, of the upper hub assembly 12 in relation to the lower hub assembly 14. The center shaft assembly 16 comprises a lower plate 60 and a center shaft 61.

Figure 9:
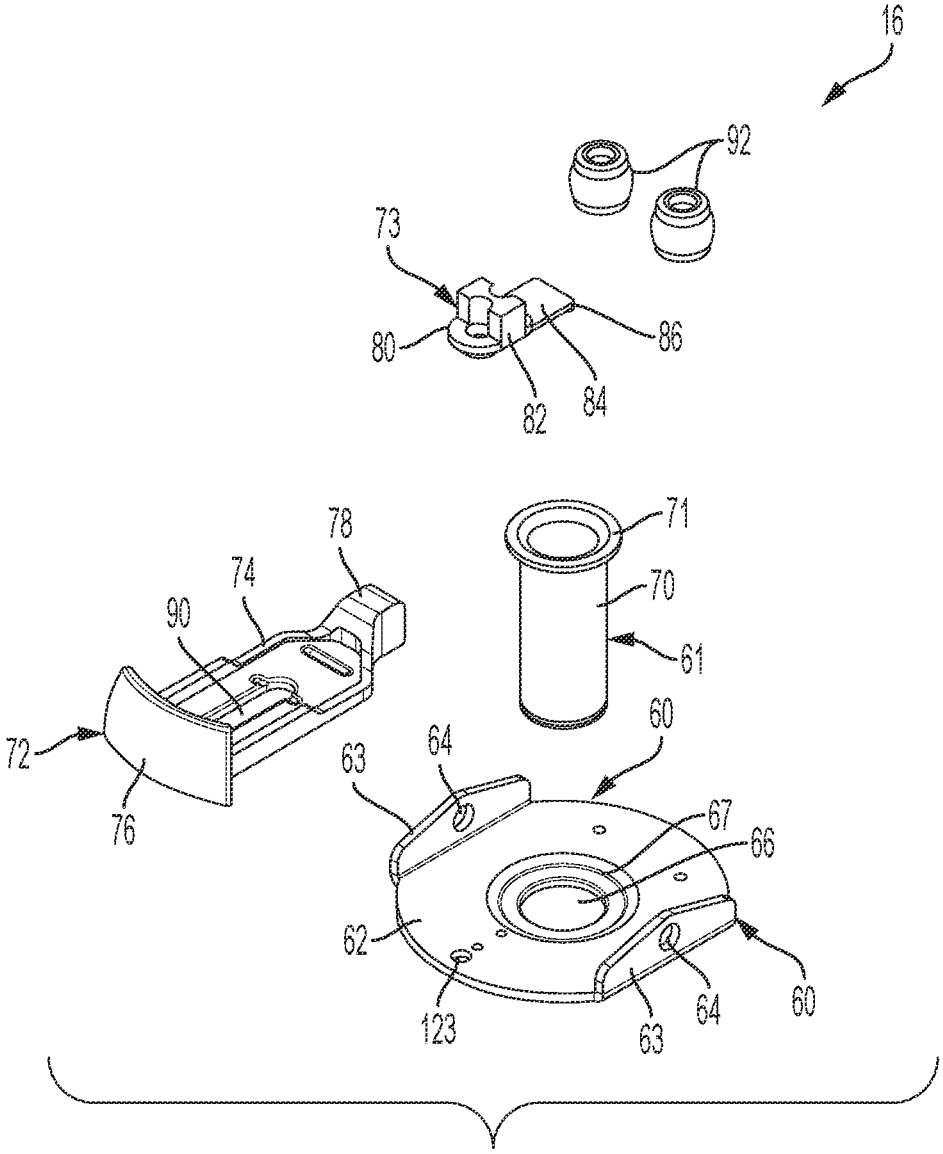
FIG. 9 is an exploded view of a center shaft assembly of the chair shown in FIGS. 1A-4.
Figure 10C:
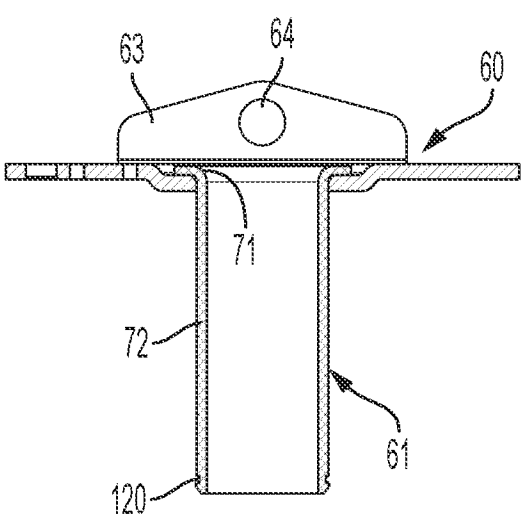
FIG. 10C is a cross-sectional view of the lower plate and the center shaft shown in FIGS. 10A and 10B, taken through the line K-K of FIG. 10B.
Figure 10B:
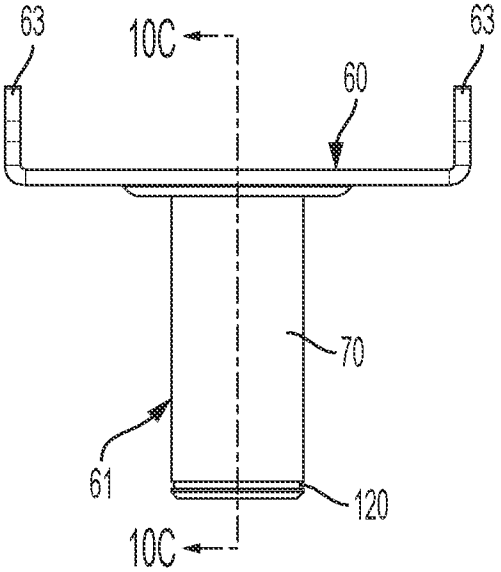
FIG. 10B is a side view of the lower plate and the center shaft shown in FIG. 10A.

Referring to FIGS. 9-10C, the lower plate 60 has a substantially planar major portion 62; and two flanges 63 that adjoin, and extend upward from opposite ends of the major portion 62 from the perspective of FIG. 10B. The major portion 62 and the flanges 63 are unitarily formed; the major portion 62 and the flanges 48 can be formed separately, and can be connected by a suitable means such as welding in alternative embodiments. Each flange 63 has a through hole 64 formed therein at the approximate center of the flange 63.

Figure 10A:
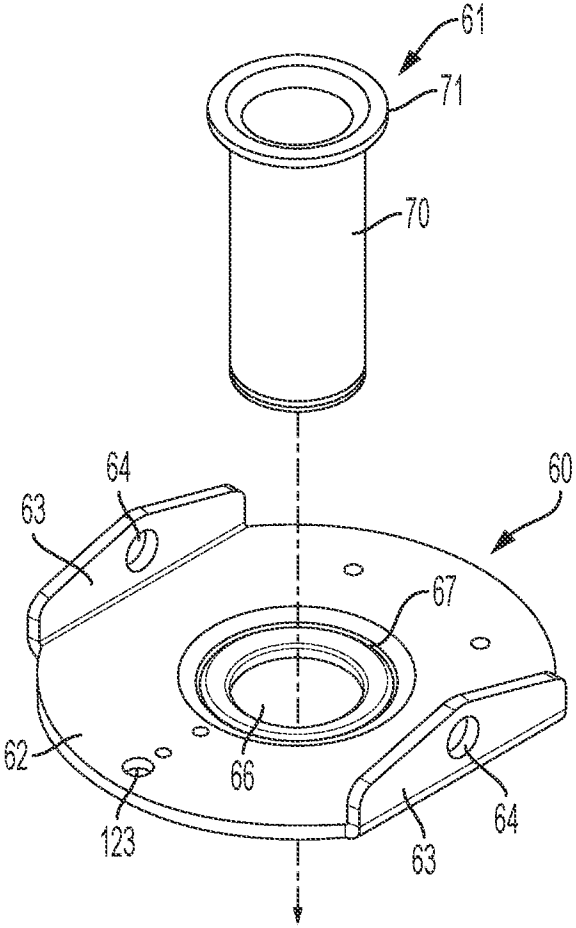
FIG. 10A is a perspective view of a lower plate and a center shaft of the center shaft assembly shown in FIG. 9
Figure 12B:
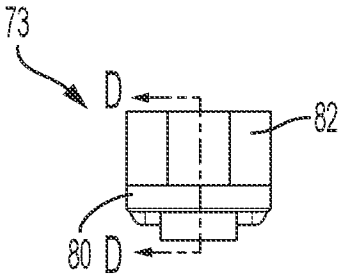
FIG. 12B is a front view of the slide retainer shown in FIG. 12A.
Figure 12D:
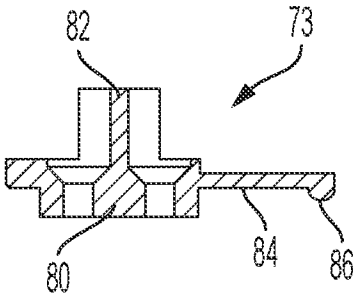
FIG. 12D is a cross-sectional view of the slide retainer shown in FIGS. 12A-12C, taken through the line F-F of FIG. 12B.
Figure 12A:
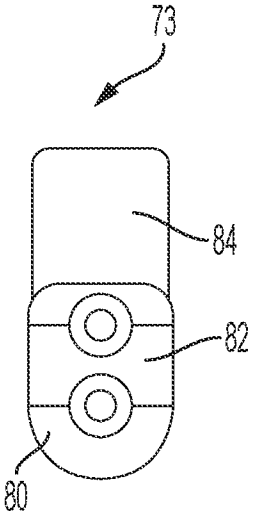
FIG. 12A is a top view of a slide retainer of the center shaft assembly shown in FIG. 9.
Figure 12C:
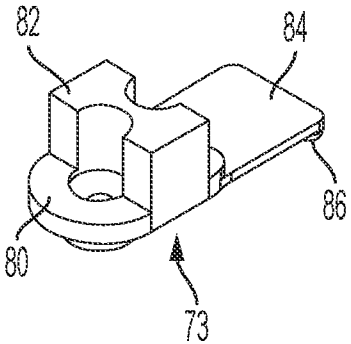
FIG. 12C is a top-front perspective view of the slide retainer shown in FIGS. 12A and 12B.
Figure 11B:
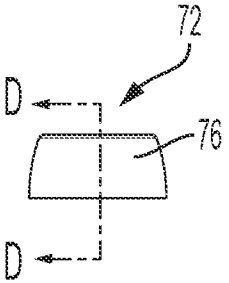
FIG. 11B is a front view of the slide lock shown in FIG. 11A.
Figure 11D:
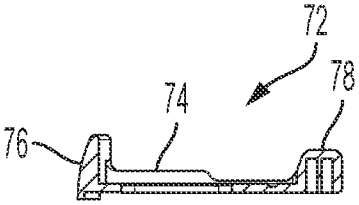
FIG. 11D is a cross-sectional view of the slide lock shown in FIGS. 11A-11C, taken through the line E-E of FIG. 11B.
Figure 11A:
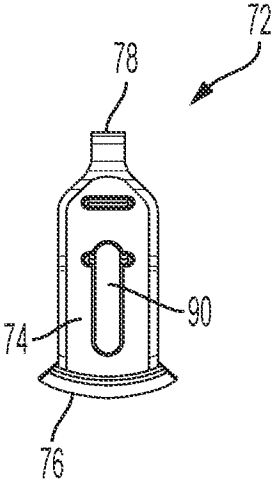
FIG. 11A is a top view of a slide lock of the center shaft assembly shown in FIG. 9.
Figure 11C:
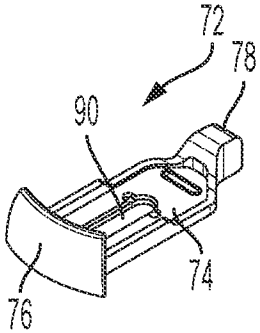
FIG. 11C is a top-front perspective view of the slide lock shown in FIGS. 11A and 11B.

A substantially circular opening 66 is formed in lower plate 60. The opening 66 centered at the approximate center of the major portion 60. A recess 67 is formed in the upper surface of the lower plate 60, as shown in FIG. 10A. The recess extends 67 around the periphery of the opening 66.

The center shaft assembly 16 is coupled to the upper hub assembly 12 by way of the lower plate 60, and the upper plate 28 of the upper hub assembly 12. In particular, the lower plate 60 and the upper plate 28 are configured so that the flanges 63 on the lower plate 60 overlap the flanges 48 of upper plate 28, i.e., each flange 63 is positioned adjacent to, and outward of a corresponding one of the flanges 48. The flanges 48, 63 are positioned so that the through hole 49 in each flange 48 aligns with the through hole 64 in the adjacent flange 63. A pin 68 is disposed in the aligned through holes 49, 64, and can be retained in the through holes 49, 64 by clips or other suitable means. The pin 68 supports and retains the upper plate 28, and the rest of the upper hub assembly 12, on the center shaft assembly 16, while allowing the upper hub assembly 12 to tilt as shown in FIGS. 21B and 22D. The lip 38 of the upper hub 26 has through holes 69 formed therein to permit the pin 68 to be inserted into the through holes 49, 64. The through holes 69 are illustrated, for example, in FIGS. 5D-5G.

Referring to FIGS. 9-10C, the center shaft 61 has a cylindrical body 70, and a flange 71 secured to an upper end of the body 67. The center shaft 61 is mounted on the lower plate 60, so that the body 70 extends through the opening 66, and the flange 71 is disposed in the recess 67. The flange 71 is secured to the lower plate by a suitable means such as welding.

The center shaft assembly 16 further comprises a slide lock 72 and a slide retainer 73. As discussed below, the slide lock 72 and the slide retainer 73 cooperate with the upper plate 28 of the upper hub assembly 12 to facilitate the tilting or reclining movement of the upper hub assembly 12. As shown in FIGS. 11A-11D, the slide lock 72 comprises an elongated body 74; a tab 76 that adjoins a first, or outer end of the body 74; and a projection or knob 78 that adjoins, and extends upward from a second, or inner end of the body 74, from the perspective of FIG. 12D. The slide lock 72 is mounted on an upper surface of the major portion 62 of the lower plate 60.

Figure 21A:
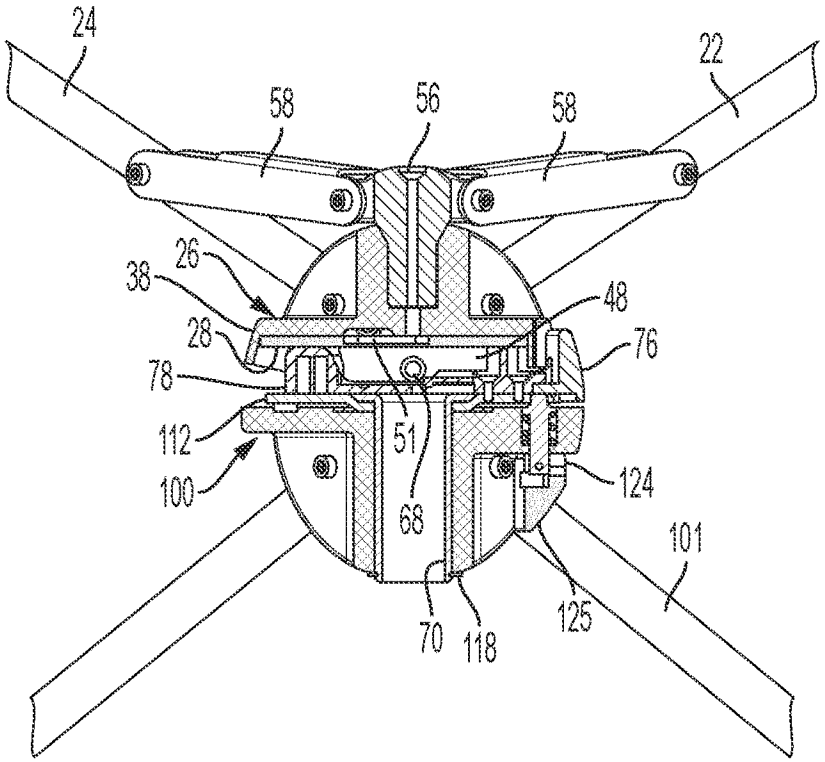
FIG. 21A is a cross-sectional view of the center shaft assembly, the portion of the upper hub assembly, and the portion of the lower hub assembly shown in FIGS. 18A-19B and 20B, depicting the chair in the unfolded, non-reclined state, with the slide lock in the locked position, and the cam lever in the locking position.
Figure 22C:
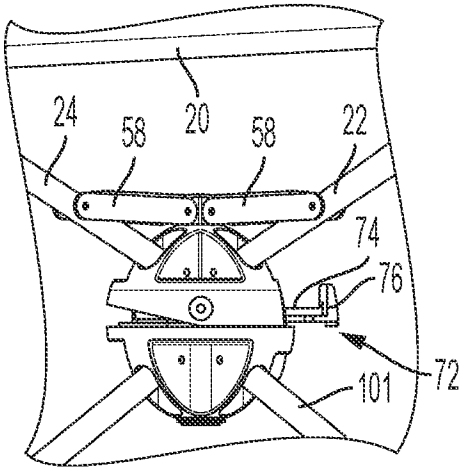
FIG. 22C is a side view of the portions of the upper and lower hub assemblies shown in FIGS. 18A-19B, 20B, 21A, and 21B, depicting the chair in the unfolded, non-reclined state, with the slide lock in the unlocked position.
Figure 22D:
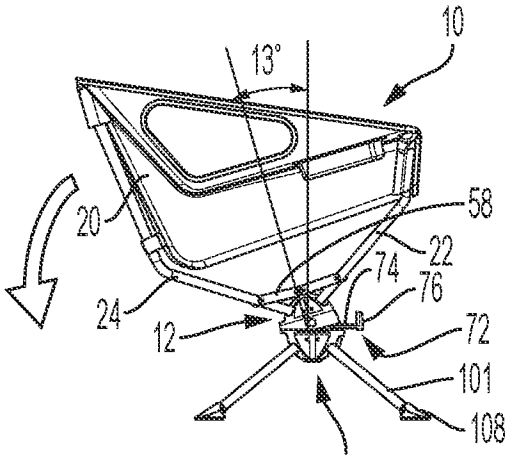
FIG. 22D is a side view of the chair shown in FIGS. 1A-4, 20A, 20C, and 22B, depicting the chair in the unfolded, reclined state with the slide lock in the unlocked position.
Figure 22A:
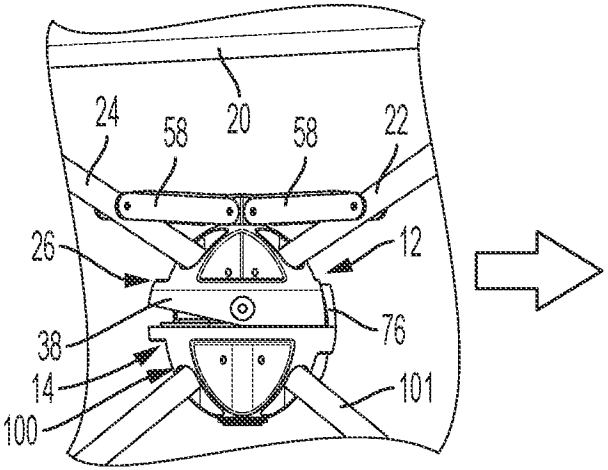
FIG. 22A is a side view of the portions of the upper and lower hub assemblies shown in FIGS. 18A-19B, 20B, 21A, and 21B, depicting the chair in the unfolded, non-reclined state, with the slide lock of the lower hub assembly in the locked position.
Figure 22B:
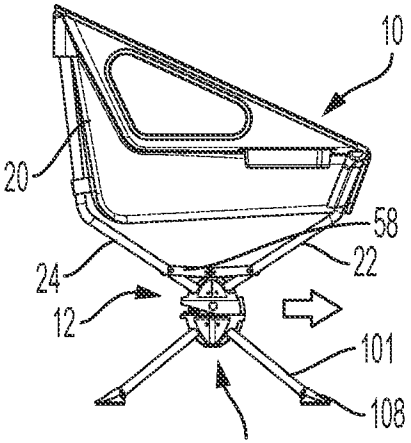
FIG. 22B is a side view of the chair shown in FIGS. 1A-4, 20A, and 20C, depicting the chair in the unfolded, non-reclined state, with the slide lock in the locked position.
Figure 23B:
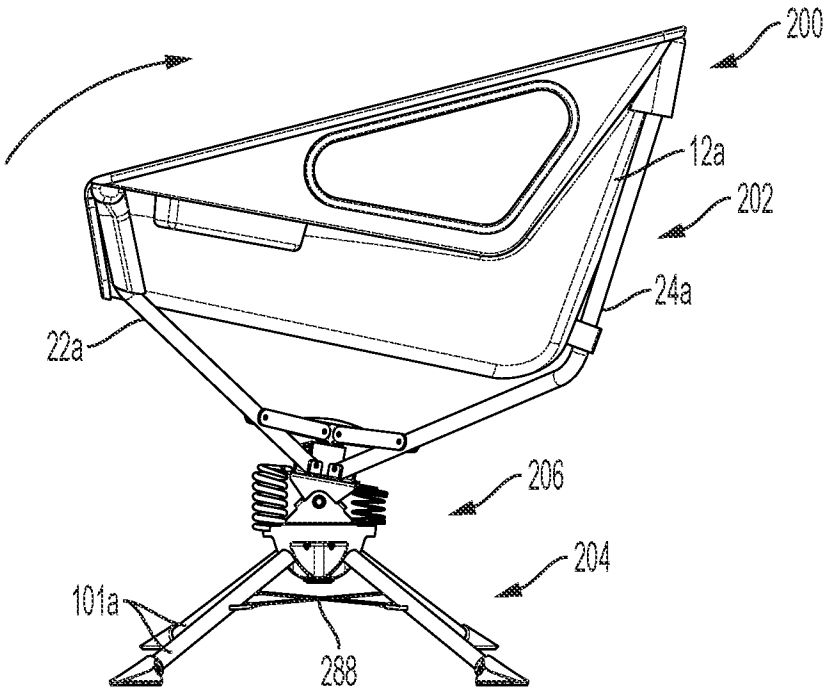
FIG. 23B is a side view of the chair shown in FIG. 23A, showing the chair in a reclined orientation and an unfolded configuration.
Figure 23A:
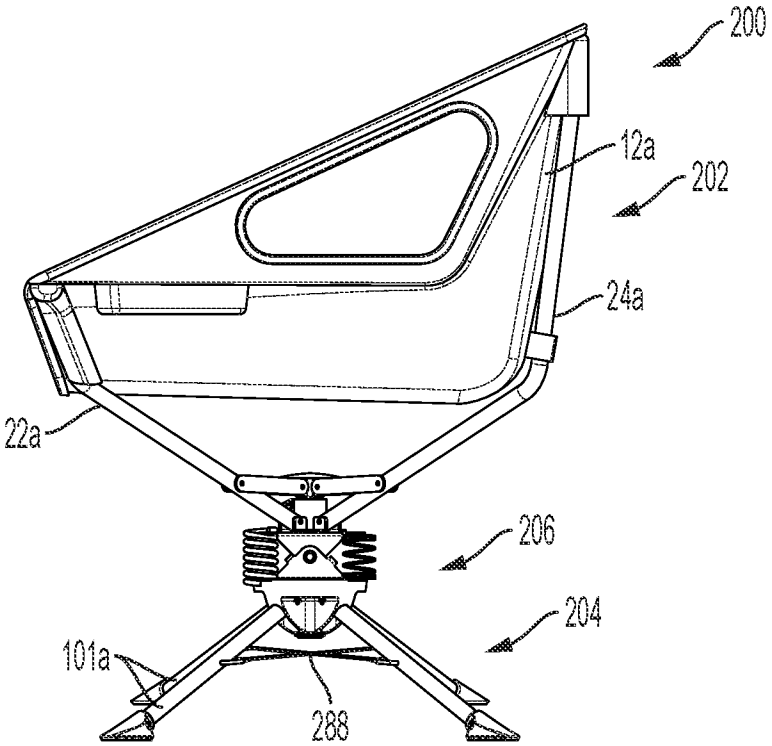
FIG. 23A is a side view of an alternative embodiment of the chair shown in FIGS. 1-22D, showing the chair in a level orientation and an unfolded configuration.

The slide lock 72 is configured to slide in relation to the lower plate 60 between an inner, or locked position shown in FIG. 21A; and an outer, or unlocked position shown in FIG. 21B. The tab 76 is positioned within the recess 40 in the upper hub 26 when the slide lock 72 is in its locked position.

The slide retainer 73 is securely mounted on the upper surface of the major portion 62 of the lower plate 60 by fasteners or other suitable means. As depicted in FIGS. 12A-12D, the slide retainer 73 comprises a body 80; a projection 82 that adjoins and extends upward from the body 80; and an arm 84 that adjoins and extends inward, i.e., toward the center of the lower plate 60. A freestanding end of the arm 84 has a rounded protrusion or nub 86 formed thereon.

The body 74 of the slide lock 72 has a slot 90 formed therein. The slot 90 extends in the lengthwise direction of the body 74. The slot 90 accommodates the lower portion, or body 80 of the slide retainer 73. The body 80 has a width about equal to the width of the slot 90, so that the body 80 fits within the slot 90 with minimal lateral, or side to side, clearance. As a result of the engagement of the body 80 and the adjacent surfaces of the slide lock 72, the slide retainer 73 guides the slide lock 72 between its inner and outer positions, and prevents movement of the slide lock 72 past the inner and outer positions.

The center shaft assembly 16 also includes two compression springs 92, shown in FIG. 9. The springs 92 are mounted on the upper surface of the major portion 62 of the lower plate 60, by a suitable means such as fasteners. An upper end of each spring 92 contacts a lower surface of the major portion 46 of the upper plate 28. The springs 92 bias the upper hub assembly 12 away from its reclined orientation.

Lower Hub Assembly

Figure 14C:
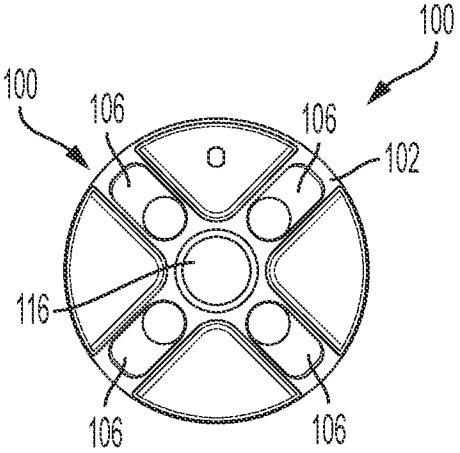
FIG. 14C is a top view of the lower hub shown in FIGS. 14A and 14B.
Figure 14F:
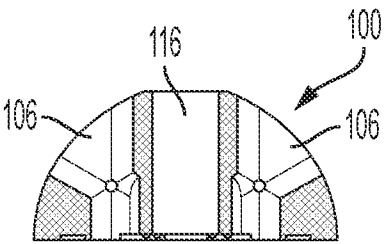
FIG. 14F is a cross-sectional view of the lower hub shown in FIGS. 14A-14E, taken through the line G-G of FIG. 14A.
Figure 14B:
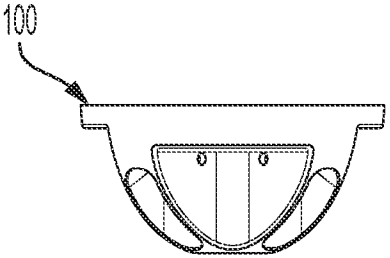
FIG. 14B is a side view of the lower hub shown in FIG. 14A.
Figure 14E:
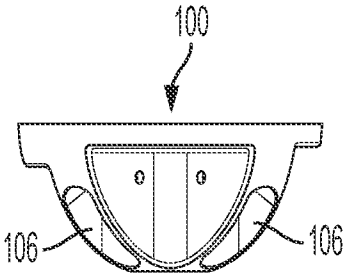
FIG. 14E is another side view of the lower hub shown in FIGS. 14A-14D, from a perspective rotated 90 degrees from the perspective of FIG. 14B.

The lower hub assembly 14 comprises a lower hub 100, and four legs 101. The lower hub 100 has a generally hemispherical outer profile, as can be seen in FIGS. 14B, 14E, and 14F. The lower hub 100 an outer surface 102, and an upper surface 104. The lower hub 100 has four recesses 106 formed therein. The recesses 106 extend inward from the outer surface 102, and are equally spaced around the outer perimeter of the lower hub 100.

The recesses 106 accommodate the legs 101. A first end of each leg 101 extends into a corresponding one of the recesses 106, and is connected to the lower hub 100 by a pin so that the leg 101 can pivot downward in relation to the lower hub 100 from the positions depicted in FIGS. 1A-2E. The legs 100 have a tubular configuration with a circular cross section. The legs 100 can be solid, and can have a cross-section other than circular in alternative embodiments. The legs 100 are formed from a rigid and durable material such as aluminum; the legs 100 can be formed from other materials in the alternative. A foot 108 is positioned over a second end of each leg 100. The feet 108 can be formed from an elastomeric or other type of material that discourages sliding of the chair 10 when the chair is positioned on a smooth surface.

Figure 13:
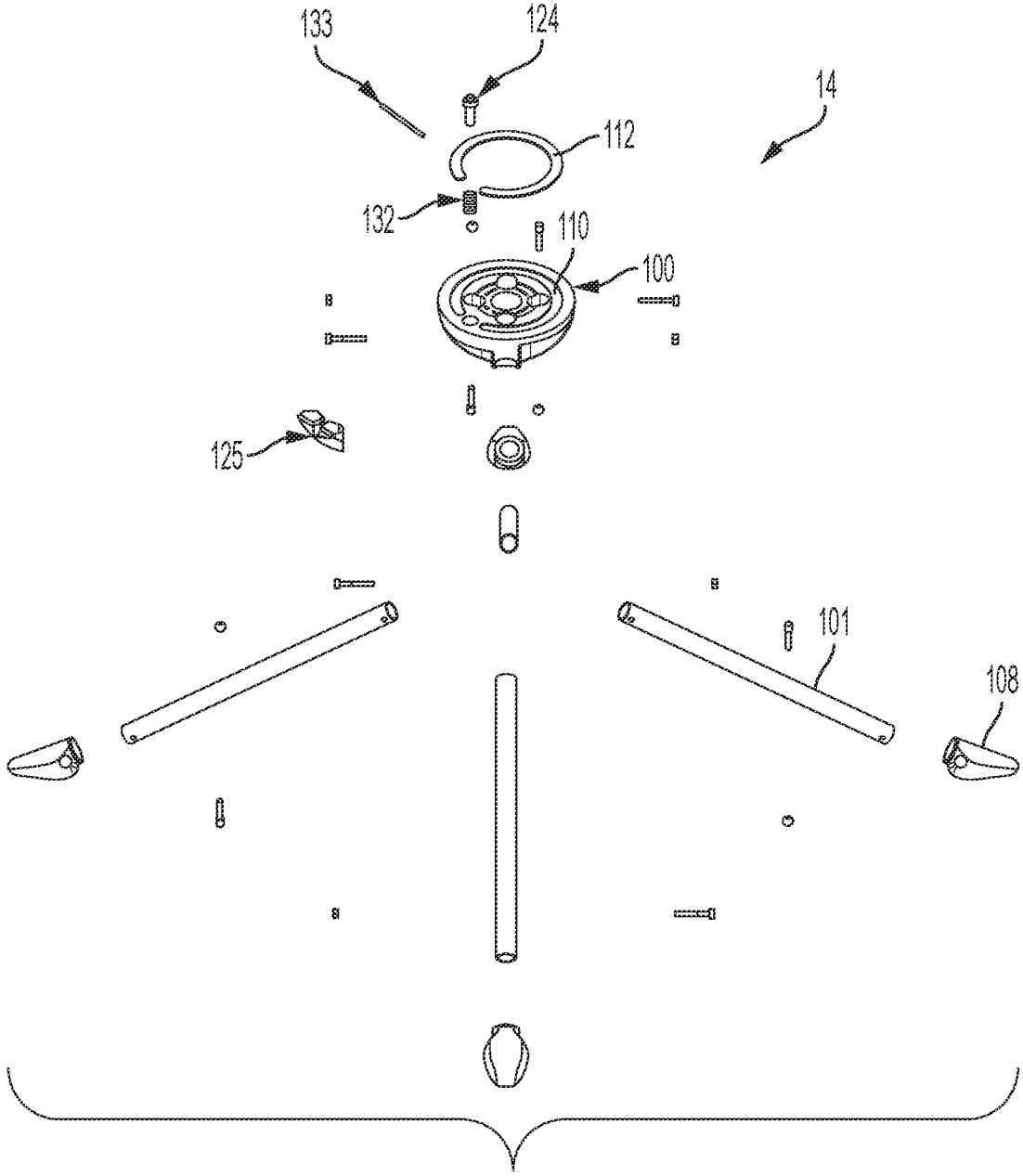
FIG. 13 is an exploded view of the lower hub assembly shown in FIGS. 3A and 3B.
Figure 14A:
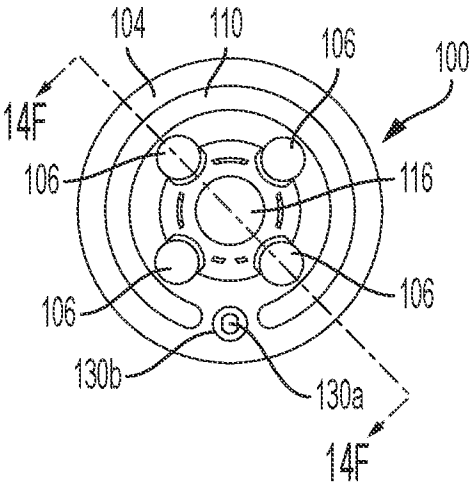
FIG. 14A is a bottom view of a lower hub of the lower hub assembly shown in FIGS. 3A, 3B, and 13.
Figure 14D:
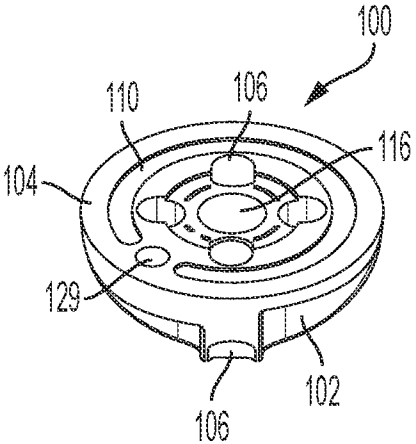
FIG. 14D is a top-front perspective view of the lower hub shown in FIGS. 14A-14C.
Figure 15A:
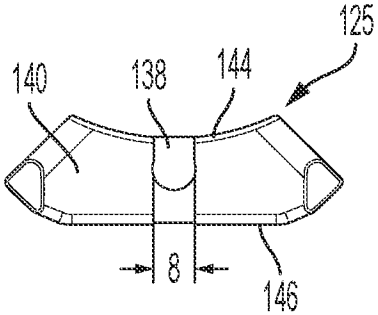
FIG. 15A is a top view of a cam lever of the lower hub assembly shown in FIGS. 3A, 3B, and 13.
Figure 15B:
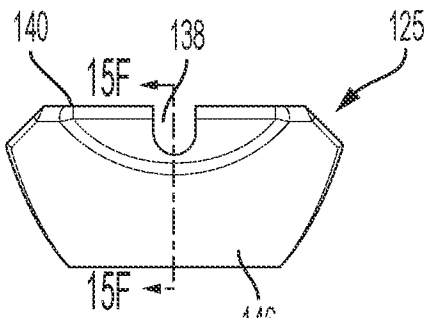
FIG. 15B is a front view of the cam lever shown in FIG. 15A.
Figure 15C:
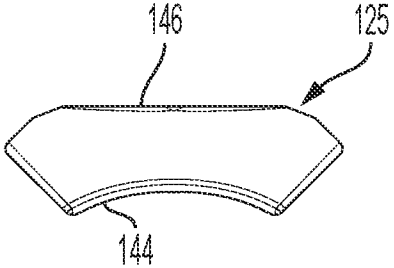
FIG. 15C is a bottom view of the cam lever shown in FIGS. 15A and 15B.
Figure 15D:
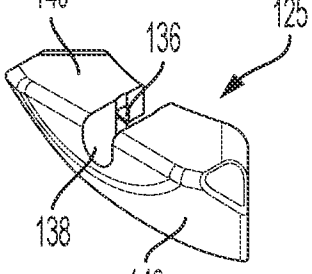
FIG. 15D is a top-front perspective view of the cam lever shown in FIGS. 15A-15C.
Figure 15E:
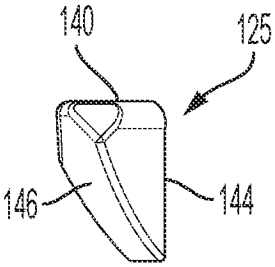
FIG. 15E is side view of the cam lever shown in FIGS. 15A-15D.
Figure 15F:
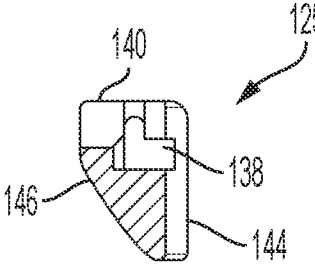
FIG. 15F is a cross-sectional view of the cam lever shown in FIGS. 15A-15E, taken through the line I-I of FIG. 15B.

The upper surface 104 of the lower hub 100 has a recess 110 formed therein, as can be seen in FIGS. 14A and 14D. The recess 110 receives a shim 112 of the lower hub assembly 14. The shim 112 is illustrated in FIG. 13. The recess 110 has a shape that is substantially matches the shape of the shim 112, so that the shim 112 fits snugly withing the recess 110.

The shim 112 acts as the contact surface between the lower hub assembly 12 and the center shaft assembly 16. The lower plate 60 of the center shaft assembly 16 rests on, and is supported by the lower hub 100 by way of the shim 112. The lower plate 60 slides along the shim 112 as the upper hub assembly 12 and the center shaft assembly 16 rotate, or swivel in relation to the lower hub assembly 14. The shim 112 can be formed from a durable material that facilitates noted sliding motion. For example, the shim 112 can be formed from high-density polyethylene (HDPE).

A cylindrical passage 116 is formed in the lower hub 100. The passage is visible in FIGS. 14A, 14C, 14D, and 14F. The passage 116 extends in a substantially vertical direction, from the perspective of FIG. 14F. The passage 116 receives the body 70 of the center shaft 61 of the center shaft assembly 16, as can be seen for example in FIGS. 18A-19B. The diameter of the passage 116 is selected so that the body 70 fits within the passage 116 with minimal clearance, allowing the body 70 to rotate within the passage 116 in relation to the lower hub 100.

A lower end of the body 70 of the center shaft 61 protrudes from a lower end of the passage 116, as shown in FIGS. 18A-19B. The center shaft assembly 16, and the attached upper hub assembly 12, are retained on the lower hub 100 by a locking ring 118 secured to the lower end of the center shaft 61. The locking ring 118 is accommodated by a groove 120 in the center shaft 61. Interference between the locking ring 118 and the adjacent surface of the lower hub 100 prevents the center shaft 61 from moving upward in relation to the lower hub 100, thereby securing the center shaft assembly 16 and the upper hub assembly 12 to the lower hub 100.

The lower hub assembly 14 further includes a lock pin 124 and a cam lever 125. The lock pin 124 and the cam lever 125 cooperate with the lower plate 60 of the lower hub assembly 14 to lock the center shaft assembly 16, and the attached upper hub assembly 12, in a particular angular orientation, or clock position, in relation to the lower hub assembly 14.

Figure 16A:
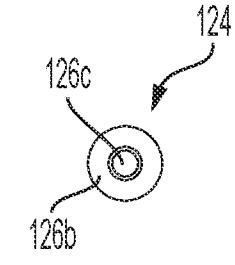
FIG. 16A is a top view of a lock pin of the lower hub assembly shown in FIGS. 3A, 3B, and 13.
Figure 16B:
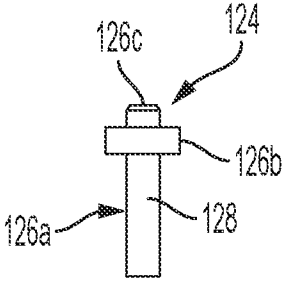
FIG. 16B is a side view of the lock pin shown in FIG. 16A.
Figure 16C:
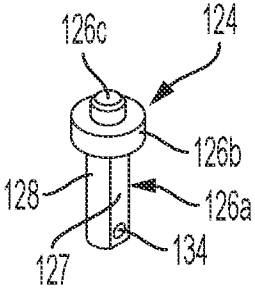
FIG. 16C is a top-front perspective view of the lock pin shown in FIGS. 16A and 16B.
Figure 16D:
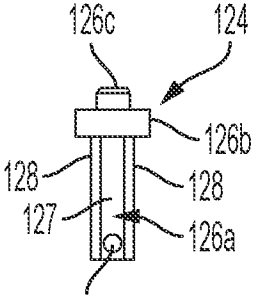
FIG. 16D is another side view of the lock pin shown in FIGS. 16A-16C, from a perspective rotated 90 degrees from the perspective of FIG. 16B.
Figure 17:
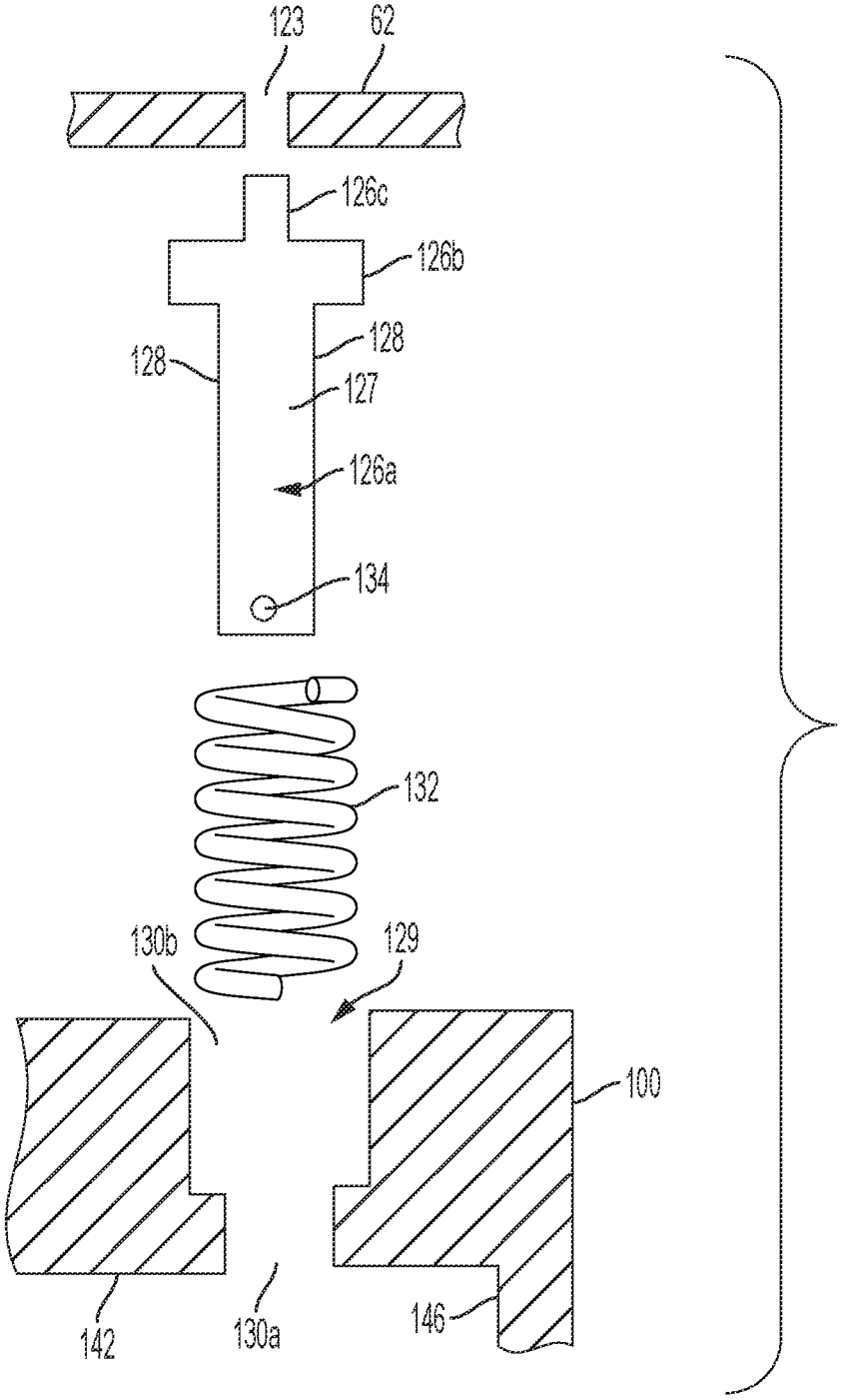
FIG. 17 is an exploded side view of a portion of the lower hub, the cam lever, and a portion of the lower plate shows in FIGS. 10A-10C, 14A-14F, and 16A-16D, depicting the lower hub and the lower plate in cross section.

Referring to FIGS. 16A-17, the lock pin 124 has a lower portion 126*a*; a middle portion 126*b* that adjoins the lower portion 126*a*; and an upper portion 126*c* that adjoins the middle portion 126*b*. The middle and upper portions 126*b*, 126*c* are cylindrical. The lower portion 126*a* has substantially flat side surfaces 127, and curvilinear forward and rearward surfaces 128.

The lock pin 124 is positioned in a cylindrical passage 129 formed in the lower hub 100. The passage 129 has a lower portion 130*a*, and an adjoining upper portion 130*b*, as shown in FIG. 17. The lower portion 130*a* of the passage 129 receives the lower portion 126*a* of the lock pin 124. The lower portion 130*a* has a diameter about equal to the spacing between the forward and rearward surfaces 128 of the lower portion 126*a* of the lock pin 124, so that the lower portion 126*a* fits within the lower portion 130*a* with minimal clearance between the forward and rearward surfaces 128 and the adjacent surfaces of the lower hub 100.

The upper portion 130*b* of the passage 129 accommodates the middle portion 126*b* and the upper portion 126*c* of the lock pin 124. The upper portion 130*b* has a diameter about equal to the diameter of the middle portion 126*b* of the lock pin 124, so that the middle portion 126*b* fits within the middle portion 130*b* of the passage 129 with minimal clearance. Because the diameter of the middle portion 126*b* of the lock pin 124 is larger than the diameter of the lower portion 130*b* of the passage 129, the structure of the lower hub 100 that defines the lower end of upper portion 130*b* acts as a stop that prevents the lock pin 124 from backing out of the passage 129 in the downward direction.

Figure 19B:
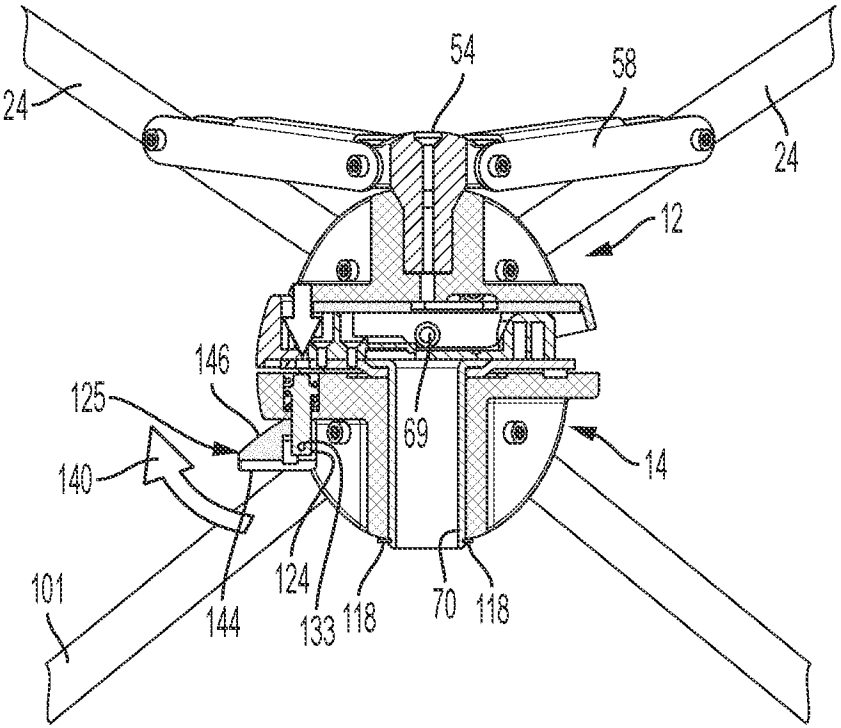
FIG. 19B is a cross-sectional view of the center shaft assembly, the portion of the upper hub assembly, and the portion of the lower hub assembly shown in FIGS. 18A-19A, depicting the chair in the unfolded, non-reclined state, with the slide lock in the locked position, and the cam lever in an unlocking position.
Figure 19A:
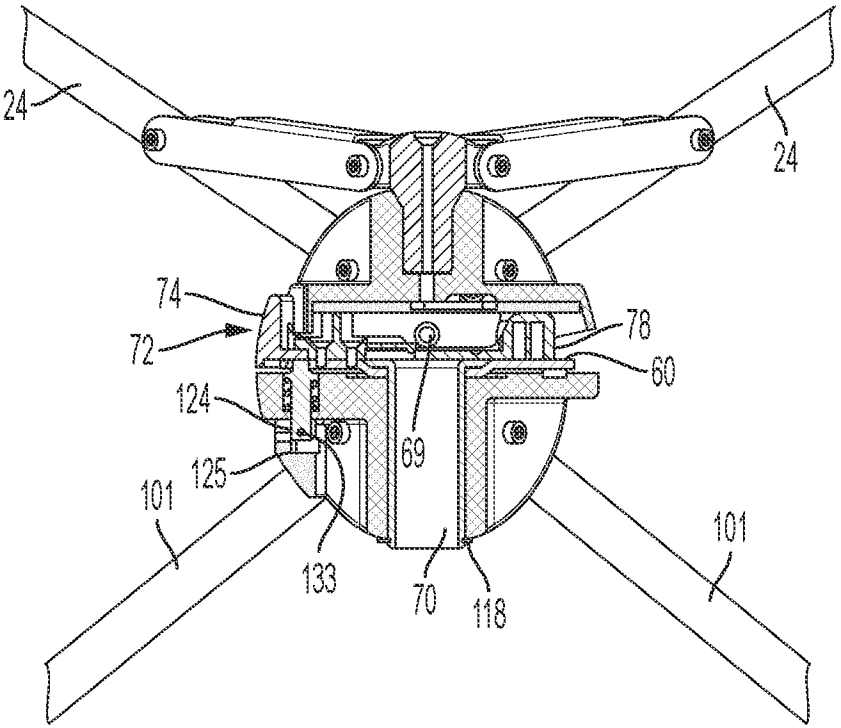
FIG. 19A is a cross-sectional view of the center shaft assembly, the portion of the upper hub assembly, and the portion of the lower hub assembly shown in FIGS. 18A and 18B, depicting the chair in the unfolded, non-reclined state, with the slide lock in the locked position, and the cam lever in the locking position.

The lock pin 124 is movable between an upper position shown in FIG. 19A, and a lower position shown in FIG. 19B. The lock pin 124 is biased in the upward direction, toward the upper position, by a compression spring 132. The spring 132 is positioned between a lower surface of the middle portion 126*b* of the lock pin 124, and the bottom of the upper portion 130*b* of the passage 129.

The upper portion 126*c* of the lock pin 124 is configured to align with a through hole 123 in the major portion 62 of the lower plate 60 of the center shaft assembly 16 when the center shaft assembly 16 and the upper hub assembly 12 are in a particular angular orientation, or clock position, in relation to the lower hub assembly 14. This particular clock position is referred to hereinafter as the locked position of the center shaft assembly 16 and the upper hub assembly 12. The spring 132 biases the upper portion 126*c* of the lock pin 124 into the through hole 123 when the center shaft assembly 16 and the upper hub assembly 12 are in their locked positions.

As can be seen in FIGS. 17, 19A, and 19B, the through hole 123 has a diameter that is about equal to the diameter of the upper portion 126*c* of the lock pin 124, so that the upper portion 126*c* fits within the through hole 123 with minimal clearance. Interference between the upper portion 126*c* and peripheral surface of the through hole 123 prevents rotation of the lower plate 60 in relation to the lower hub 100 when the lock pin 124 is in its upper position, which in turn retains the center shaft assembly 16 and the upper hub assembly 12 their locked positions.

The cam lever 125 is coupled to the bottom portion 126*a* of the lock pin 124 by a dowel pin 133. The dowel pin 133 is depicted in FIG. 13, and extends through the lock pin 124 by way of a through hole 134 formed in the lower portion 126*a* of the lock pin 124. The dowel pin 133 also extends through a minor recess 136 the cam lever 125. The minor recess can be seen, for example, in FIGS. 15D and 15F The minor recess 136 faces downward when the cam lever 125 is in its locking position, so that the dowel pin 133, which is biased upward by the spring pin 124, remains captured within the minor recess 136 when the cam lever 125 is in its locking position, thereby retaining the cam lever 125 on the lower hub assembly 14. Also, as depicted in FIG. 19D, an upper surface 140 of the cam lever 125 is drawn into contact with a downwardly-facing surface 142 of the lower hub 100 by the upward bias of the locking pin 124; and a side surface 144 of the cam lever 124 faces inward and contacts an outwardly-facing surface 146 of the lower hub 100 when the cam lever 125 is in its locking position. The downwardly-facing surface 142, side surface 144, and outwardly-facing surface 146 of the cam lever 125 are visible in FIGS. 15A-15F.

The cam lever 125 also defines a major recess 138 that adjoins the minor recess 136. The major recess 138 is configured to accommodate the lower portion 126*a* of the lock pin 124 when the cam lever 125 is in its locking and unlocking positions.

The cam lever 125 can be moved from its locking position to its unlocking position by lifting the bottom edge of the cam lever 125 upward and outward so that the cam lever 125 rotates in a clockwise direction, as denoted by the arrow 140 in FIG. 19B. The clockwise rotation of the cam lever 125 causes the upper surface 140 of the cam member 125 to rotate toward the outwardly-facing surface 146 of the lower hub 100, while the corner of the cam lever 146 between the upper surface 140 and a front surface 146 of the cam lever 145 slides inwardly along the downwardly-facing surface 142. The corner eventually moves far enough inward so that the upward bias of the spring pin 124 pulls the front surface 146 into contact with the downwardly-facing surface 142.

At this point, the cam member 125 has rotated ninety degrees to its unlocking position, the top surface of the cam member 125 faces the outwardly-facing surface 146 of the lower hub 100; and the side surface 144 of the cam lever 124 faces downward, as depicted in FIG. 19B. Also, as can be seen by comparing FIGS. 19A and 19B, the dowel pin 133 that connects the cam lever 124 and the lock pin 124 has been drawn downward by the rotation of the cam member 125. The downward movement of the dowel pin 133 imparts a corresponding downward movement to the lock pin 124, drawing the upper portion 126*c* of the locking pin 124 out of the through hole 123 in the lower plate 60 as the lock pin 124 moves to its lower or unlocked position.

As can be seen in FIG. 19B, the lock pin 124, when in its unlocked position, no longer interferes with rotation of the center shaft assembly 16 and the upper hub assembly 12. Thus, the user can swivel the upper hub assembly 12, including the chair skin 20 that provides the seating area for the user, to any desired angular position in relation to the ground or other supporting surface, as denoted by the arrows 141 in FIG. 20C. The user can unlock and swivel the upper hub assembly 12 from a seated position in the chair 10, or from a standing position next to the chair.

If the user subsequently desires to lock the upper hub assembly 12 against rotation, the user can rotate the cam lever 125 back to its locking position, and rotate the upper hub assembly 12 back toward its locked position. With the cam lever 125 in its locked position, the locking pin 124 will return to its upper position upon aligning with the through hole 123 in the lower plate 60. The resulting re-insertion of the upper portion 128*c* of the locking pin 124 in the through hole 123 once again will prevent the center shaft assembly 16 and the upper hub assembly 12 from rotating in relation to the lower hub assembly 14, thereby securing the center shaft assembly 16 and the upper hub assembly 12 in their locked positions.

The upper hub assembly 12, including the seating area defined by the chair skin 20, can be reclined or tilted as follows. The reclining movement of the upper hub assembly 12 is controlled by the slide lock 72. The slide lock 72 is configured to slide in relation to the lower plate 60 of the center shaft assembly 16 between an inner, or locked position shown in FIG. 21A; and an outer, or unlocked position shown in FIG. 21B. As can be seen in FIG. 21A, when the slide lock 72 is in the locked position, the projection or knob 78 of the slide lock 72 is offset from, i.e., is not aligned with, the opening 51 in the upper plate 28. In this state, the upper hub assembly 12 is prevented from tilting backward, i.e., away from the direction the seating area is facing, by the knob 78, which is positioned beneath the major portion 46 of the upper plate 28 and interferes with the downward movement of the adjacent surface of the major portion 46. The upper hub assembly 12 is prevented from tilting in the forward direction by interference between the upper surface of the projection 82 of the slide retainer 73, and the adjacent surface of the major portion 46, as can be seen for example in FIG. 21A.

The user can move the slide lock 72 to its unlocked position be pulling the tab 76 of the slide lock 72. The resulting movement of the slide lock 72 causes the knob 78 to move inward, to a position directly below the opening 51, as illustrated in FIG. 21B. Thus, the knob 78 no longer is positioned directly below the major portion 46, and no longer interferes with the tilting motion of the upper hub assembly 12. The user can recline the upper hub assembly 12, including the seating area, by leaning back to overcome the bias of the springs 92. The angled orientation of the lower edge of the lip 38 of the upper hub 26 prevents the lip 38 from interfering with the tilting of the upper hub assembly 12. Also, as can be seen in FIG. 19B, the protrusion or nub 86 on the arm 84 of the slide retainer 73 becomes disposed in a recess in the body 74 of the slide lock 72. The engagement of the nub 86 and the slide lock 72 helps to maintain the slide lock in its unlocked position.

When the user wishes to secure the upper hub assembly 12 in its non-reclined, or level orientation, the user can tilt the upper hub assembly 12 back into its level orientation, and push the tab 76 of the slide lock 72 inward, to return the slide lock 72 to its locked position.

The reclining and swiveling features of the chair 10 are independent of each other. The upper hub assembly 12 can be reclined in any angular, or clock position of the upper hub assembly 12. The upper hub assembly 12 likewise can be rotated or swiveled when the upper hub assembly 12 is in its reclined and level orientations.

FIGS. 23A-36 depict an alternative embodiment of the chair 10 in the form of a chair 200. The chair 200 includes an upper hub assembly 202, a lower hub assembly 204, and a center shaft assembly 206. The upper hub assembly 202 provides the seating area for a user. The lower hub assembly 204 contacts the ground or other supporting surface, and acts as a base that supports the remainder of the chair 200. The center shaft assembly 206 couples the upper hub assembly 202 to the lower hub assembly 204, and facilitates rotation and tilting of the upper hub assembly 202 in relation to the lower hub assembly 204.

The upper hub assembly 202 and the lower hub assembly 204 are substantially similar to the respective upper hub assembly 12 and lower hub assembly 14 of the chair 10, with the exceptions noted below or evident from the figures. Components of the upper hub assembly 202 and the lower hub assembly 204 that are substantially identical to those of the respective upper hub assembly 12 and lower hub assembly 14 are denoted using identical reference characters.

Figure 29:
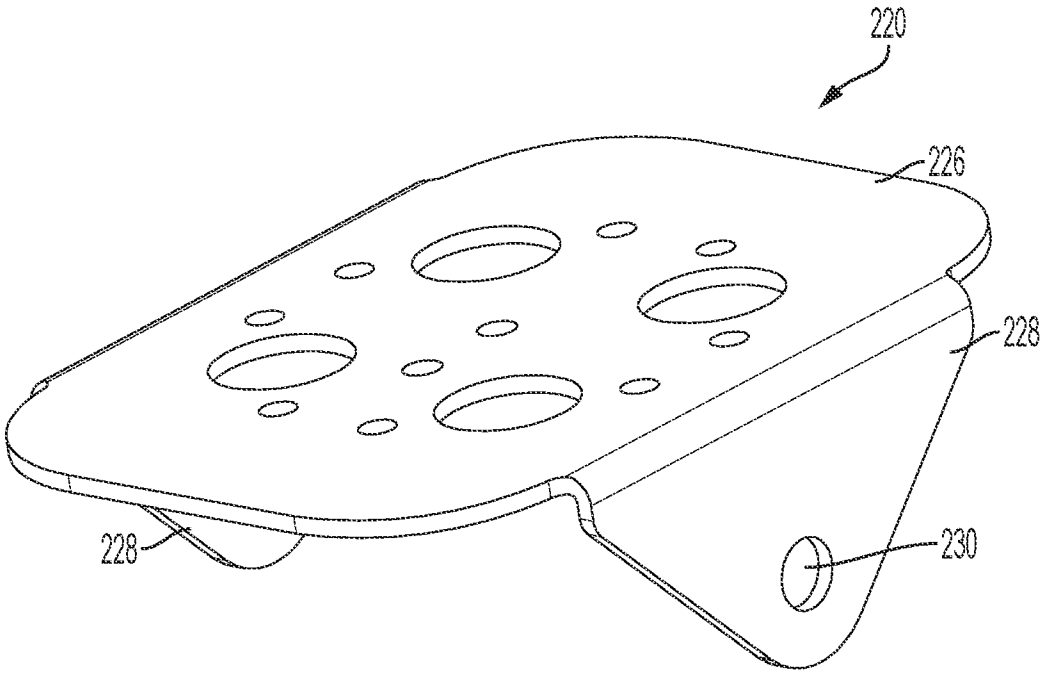
FIG. 29 is a top-perspective view of an upper plate of a center shaft assembly of the chair shown in FIGS. 23A-28.

The center shaft assembly 206 includes a first or lower plate 222, a second or upper plate 220, two compression springs 224, and two extension springs 225. Referring to FIG. 29, the upper plate 220 has a substantially planar major portion 226; and two substantially triangular flanges 228 that adjoin, and extend downward from opposite ends of the major portion 226. The major portion 226 and the flanges 228 are unitarily formed; the major portion 226 and the flanges 228 can be formed separately, and can be connected by a suitable means such as welding in alternative embodiments. Each flange 228 has a centrally located hole 230 formed therein.

Figure 32:
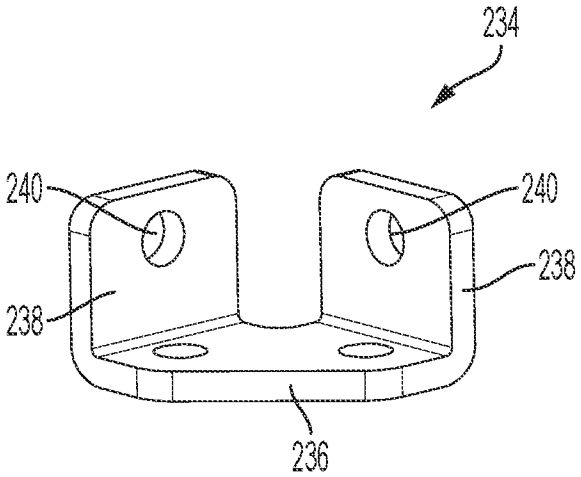
FIG. 32 is a front view of a u-plate of the center shaft assembly of the chair shown in FIGS. 23A-31.

The center shaft assembly 206 also includes a center support lock 232, and four u-plates 234. The center support lock 232 and the u-plates 243 connect the upper hub assembly 202 to the upper plate 220, as can be seen, for example, in FIG. 27. Referring to FIG. 32, each u-plate 234 has a base 236, and two flanges 238 that adjoin, and extend upward from the base 236. The base 236 is secured to an upper surface of the upper plate 220 by fasteners or other suitable means. Each flange 238 has a hole 240 formed therein. The u-plates 234 are positioned so that each flange 238 faces, and is spaced apart from one of the flanges 238 of an adjacent u-plate 234, with the holes 240 in the adjacent flanges 238 aligning with each other.

Figure 27:
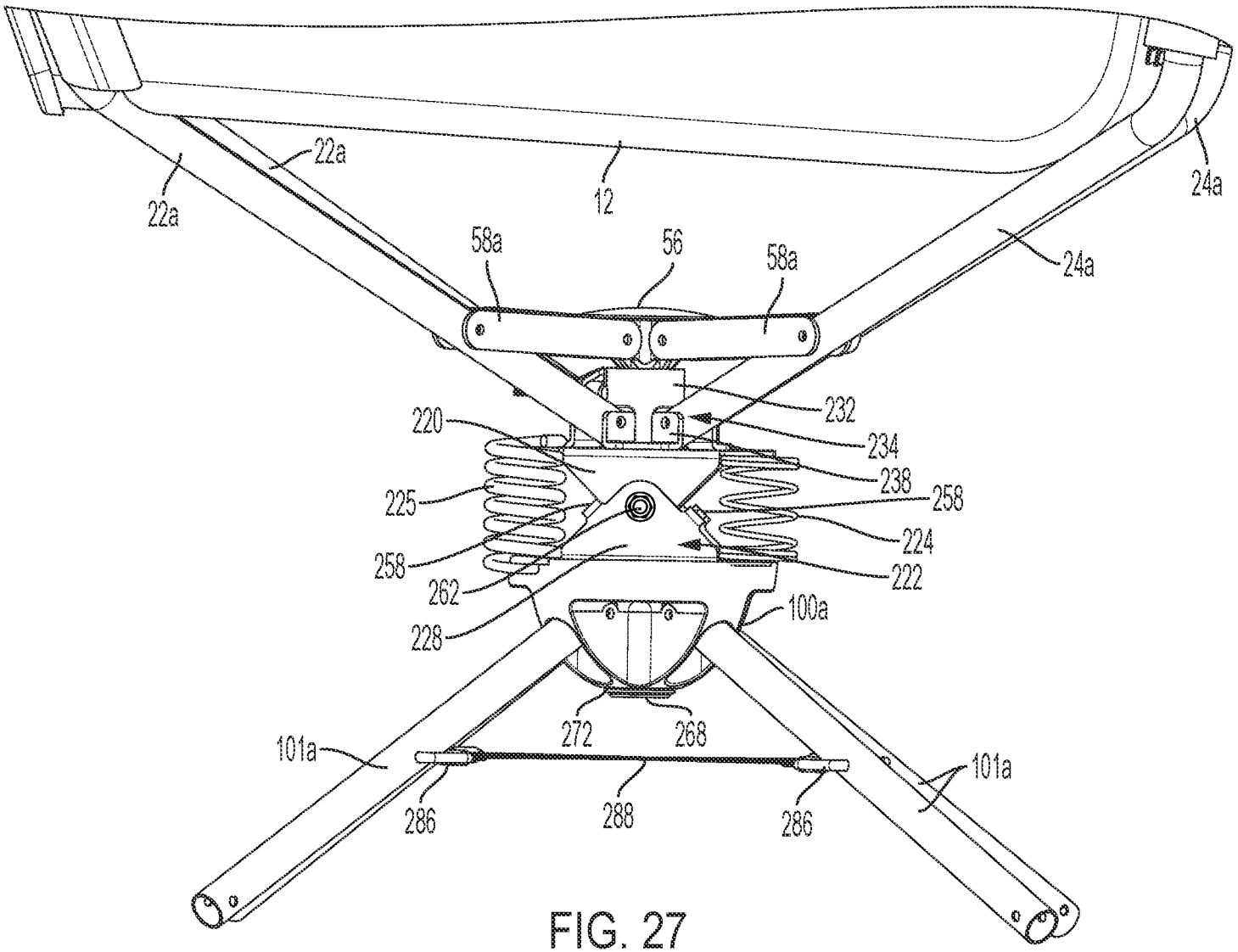
FIG. 27 is a magnified view of the area designated "A" in FIG. 24A, rotated by about 90 degrees from the perspective of FIG. 24A.

As can be seen in FIGS. 23A-24B, the upper hub assembly 12 comprises a chair skin 20*a*, two front seat bars 22*a*, and two back seat bars 24*a*. The chair skin 20*a*, front seat bars 22*a*, and back seat bars 24*a* are similar, or substantially identical to the respective chair skin 20, front seat bars 22, and back seat bars 24 of the chair 10. The front seat bars 22*a* and the back seat bars 24*a* of the chair 200 are pivotally coupled to the center shaft assembly 206 by way of the u-plates 234. In particular, an end of each front seat bar 22*a* or back seat bar 22*b* is positioned between an adjacent pair of flanges 238 of the u-plates 234, as can be seen in FIG. 27. The front seat bar 22*a* or back seat bar 22*b* is pivotally coupled to the flanges 238 by a pin (not shown) inserted through the holes 240 in the flanges 238, and holes (not shown) in the front seat bar 22*a* or the back seat bar 22*b*.

Figure 26:
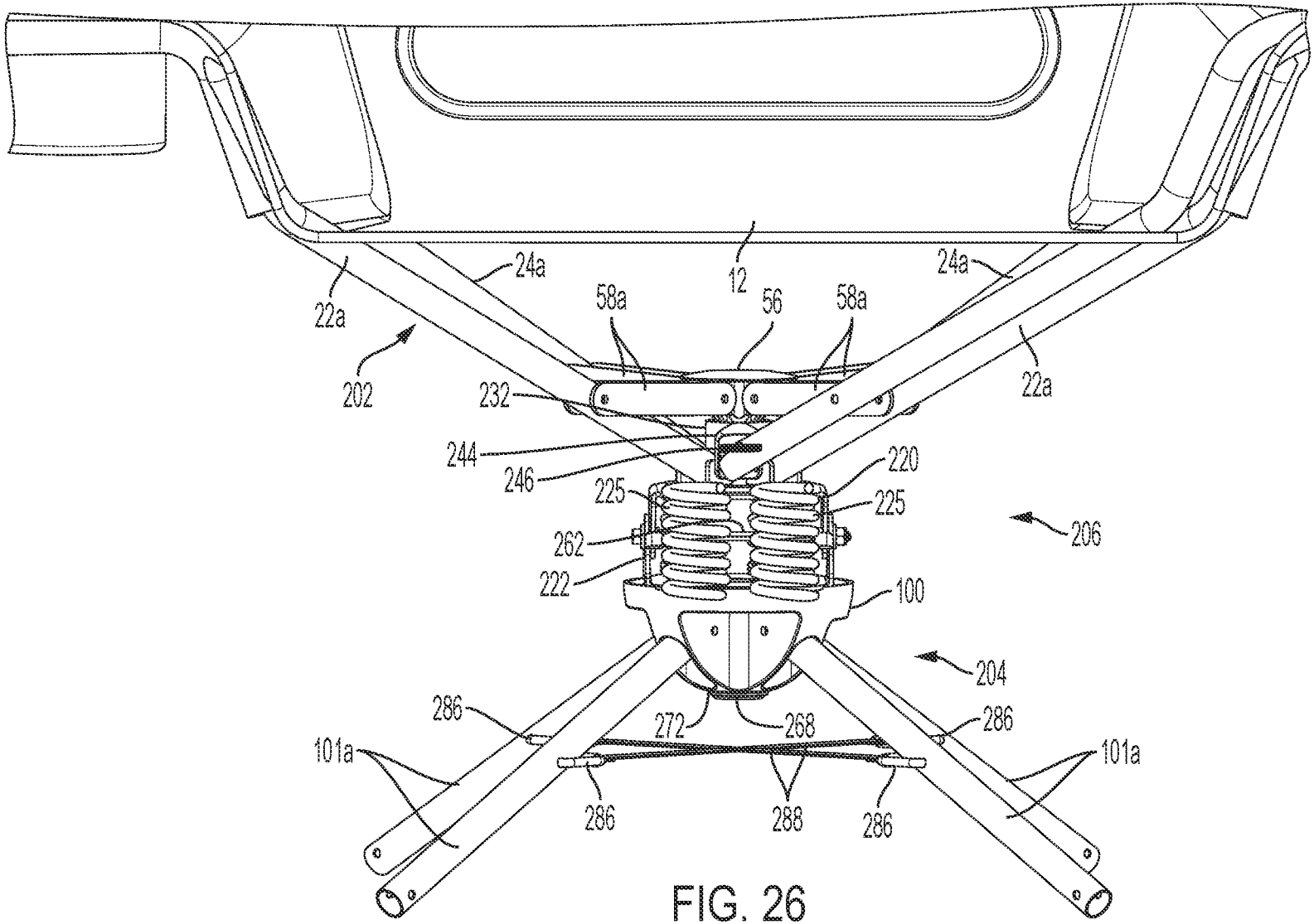
FIG. 26 is a magnified view of the area designated "A" in FIG. 24A.
Figure 34:
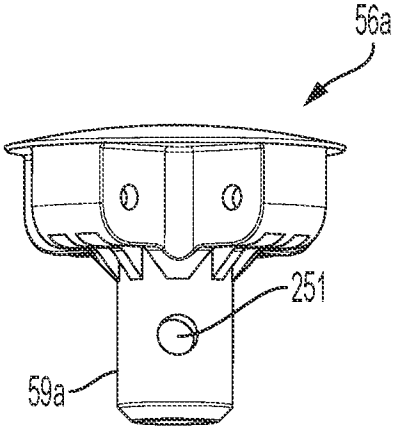
FIG. 34 is a front view of a center support of the center shaft assembly of the chair shown in FIGS. 23A-33.

The upper hub assembly 202 further includes a center support 56*a* and links 58*a* that are substantially similar, or identical to the respective center support 56*a* and links 58 of the chair 10. The center support 56*a* is shown in FIG. 34. Each link 58*a* is pivotally coupled to the center support 56*a*, and to a respective front seat bar 22*a* or back seat bar 24*a*, as can be seen in FIGS. 26 and 27.

Figure 33:
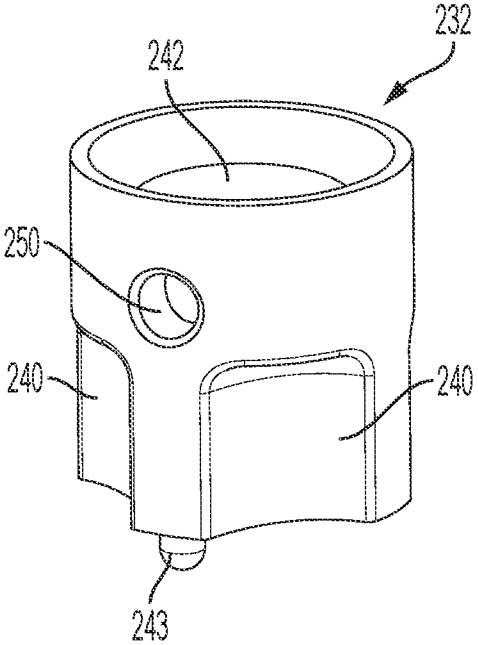
FIG. 33 is a top-perspective view of a center support lock of the center shaft assembly of the chair shown in FIGS. 23A-32.

Referring to FIG. 33, the support lock 232 of the center shaft assembly 206 is substantially cylindrical, and has a cavity 242 that extends inward, from the top of the support lock 232. The support lock 232 has four recesses 240 formed in the outer surface thereof, to provide clearance between the support lock 232, and the front seat bars 22*a* and back seat bars 22*b* as the front seat bars 22*a* and back seat bars 22*b* pivot during folding and unfolding of the chair 200. The support lock 232 has a hole 250 formed therein and extending between an outer surface of the support lock 232 and the cavity 242.

The support lock 232 is secured to the upper surface of the major portion 226 of the upper plate 220 by fasteners or other suitable means, as illustrated in FIG. 27. The support lock 232 has a downwardly-extending projection 243, visible in FIG. 33. The projection 243 engages the upper plate 220 by way of a hole formed in the major portion 226 of the upper plate 220. The engagement of the projection 243 and the upper plate 220 helps to prevent rotation of the support lock 232 in relation to the upper plate 220.

Figure 25B:
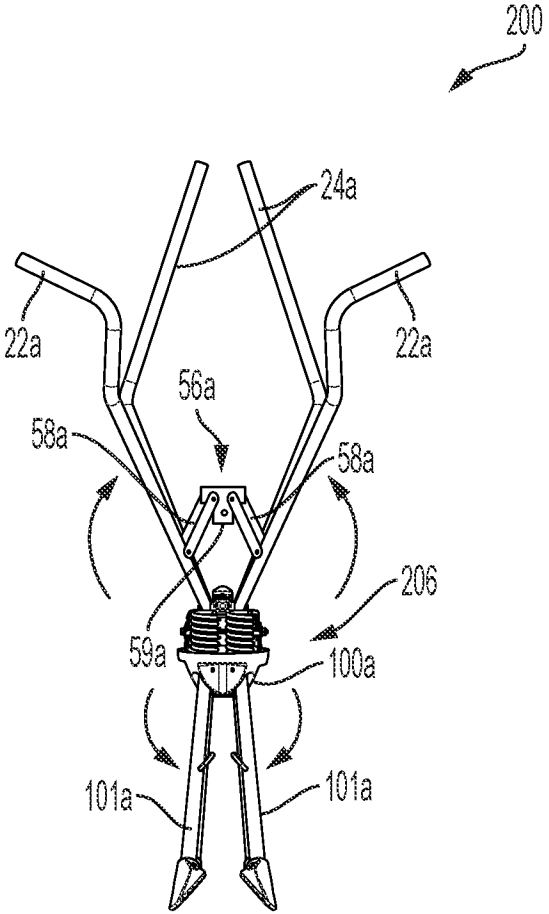
FIG. 25B is a front view of the chair shown in FIGS. 23A-24B, showing the chair in a folded configuration, with the chair skin removed for clarity of illustration.
Figure 25A:
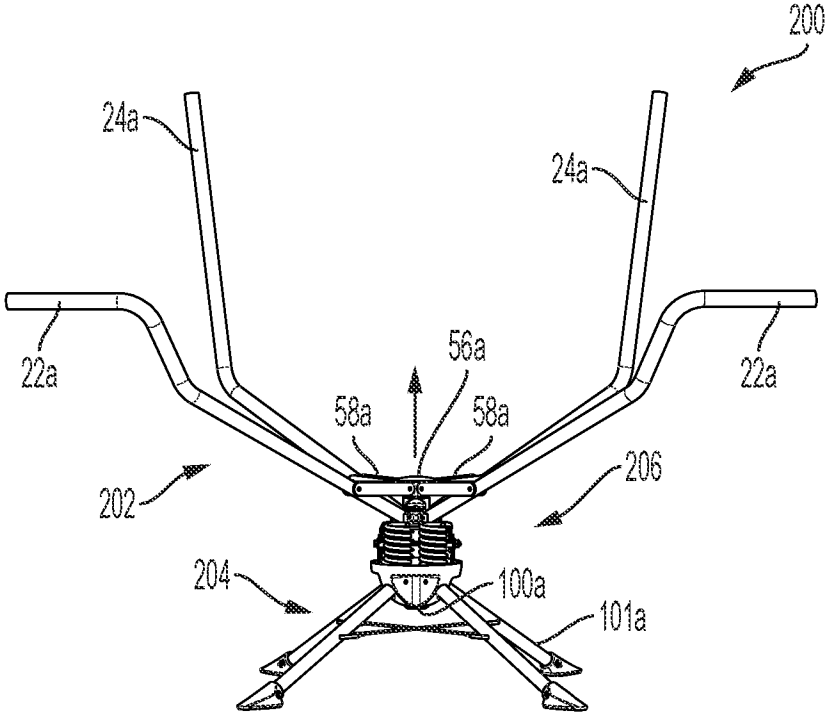
FIG. 25A is a front view of the chair shown in FIGS. 23A-24B, showing the chair in a level orientation and an unfolded configuration, with a chair skin of the chair removed for clarity of illustration.

The cavity 242 in the support lock 232 receives a body 59*a* of the center support 56*a* of the upper hub assembly 202 when the chair 200 is in its unfolded state, as can be seen in FIGS. 25A and 26-28. The body 59*a* has a shape and dimensions about the same as those of the cavity 242, so that the body 59*a* fits within the cavity 242 with minimal clearance. In a manner similar to that discussed above in relation to the chair 10, the center support 56*a* and the links 58*a* exert a stabilizing effect on the front seat bars 22*a* and the back seat bars 24*a*, and the attached chair skin 20, when the chair 202 is in its unfolded state. Also, the front seat bars 22*a*, the back seat bars 24*a*, the links 58*a*, and the center support 56*a* cooperate so that the body 59*a* is lifted out of the cavity 242 as the chair is folded, as can be seen in FIG. 25B.

Figure 28:
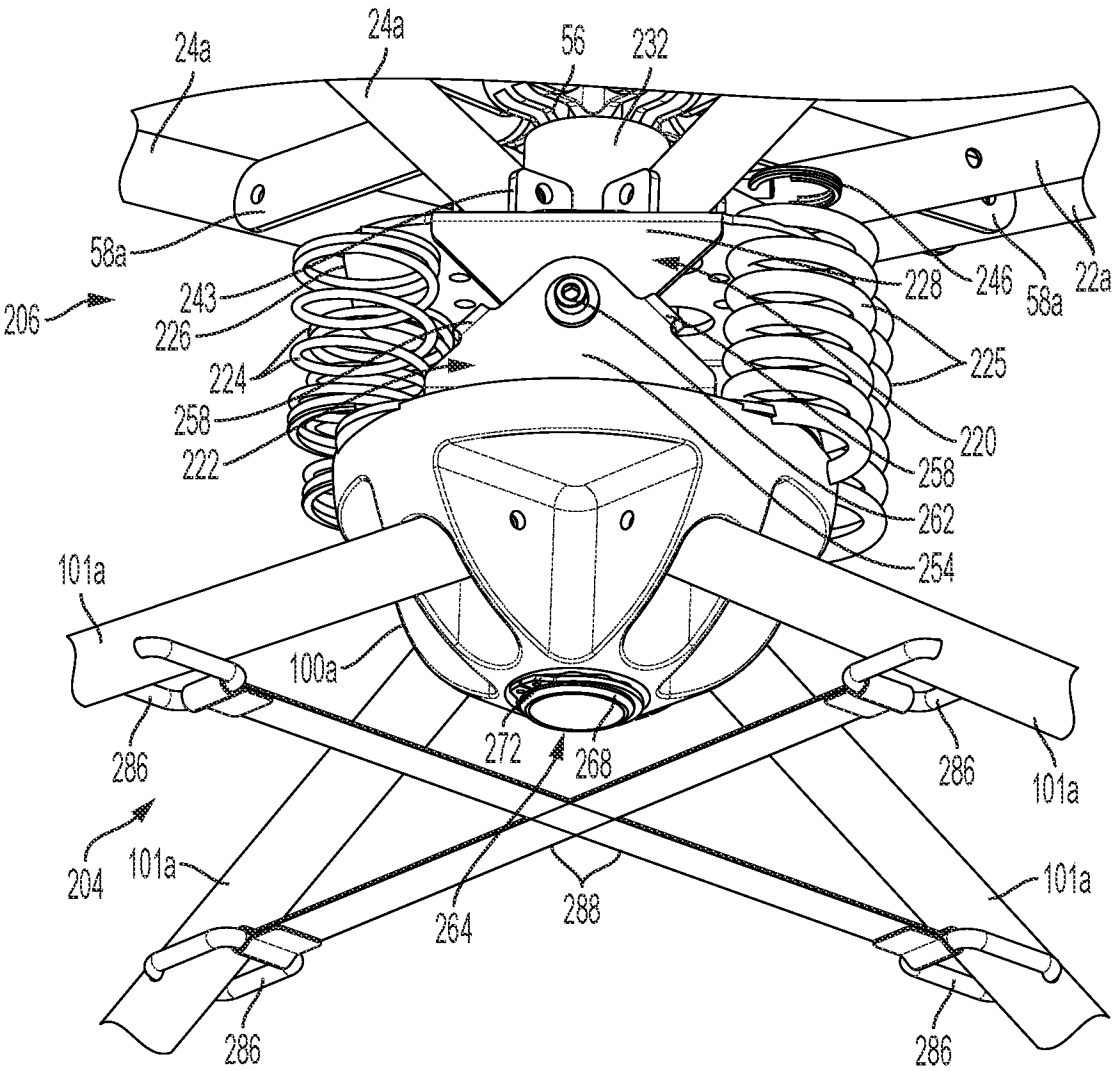
FIG. 28 is a magnified bottom-perspective view of the area designated "A" in FIG. 24A.
Figure 35:
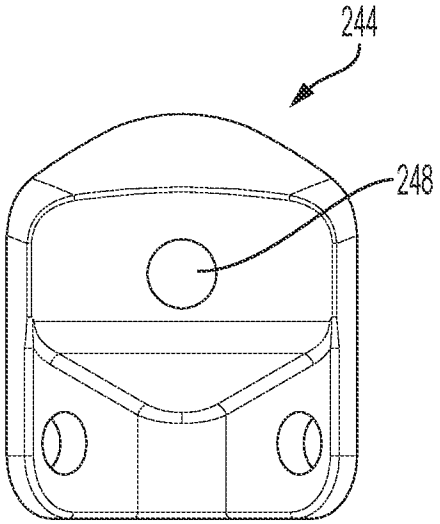
FIG. 35 is a front view of a pull pin housing of the center shaft assembly of the chair shown in FIGS. 23A-34.

The center shaft assembly 206 also includes a pull pin housing 244 and a pull pin 246, shown in FIGS. 26, 28, and 35. The pull pin 246 secures the body 59*a* of the center support 56*a* to the support lock 232 when the body 59*a* is positioned within the cavity 242. The pull pin housing 244 has a hole 248 formed therein. The pull pin housing 244 is secured to two adjacent upper side u-plates 234 using fasteners or other suitable means, and is positioned so that the hole 248 aligns with the hole 250 in the support lock 232. The hole 248 and the hole 250 align with a hole 251 in the body 59*a* when the body 59*a* is fully inserted into the cavity 242. The pull pin 246 is sized to fit with the holes 248, 250, 251 with minimal clearance, so that the pin 246 remains in the holes 248, 250, 251 once inserted therein. The pull pin 246, when engaging the pull pin housing 244, support lock 232, and body 59*a* in this manner, prevents the body 59*a* from being lifted out of the cavity 242, thereby helping to secure the chair 200 in its unfolded configuration. Also, the pull pin 246 can perform this restraining function while the upper hub assembly 202 is reclining or rotating, i.e., the engagement of the pull pin 246 with the pull pin housing 244, support lock 232, and body 59*a* does not interfere with the tilting or swiveling movement of the upper hub assembly 202 in relation to the lower hub assembly 204 and the ground.

Alternative embodiments of the chair 200 can include other means for retaining the center support 56*a* in the support lock 232 when the chair 200 is unfolded. For example, alternative embodiments of the support lock 232 and/or the center support 56*a* can include a latch, a switch, a screw, a threaded coupling, or other means for retaining the center support 56*a* in the support lock 232. Other alternative embodiments of the chair 200 can include means that act directly on the front seat bars 22 and the back seat bars 24 to lock the front seat bars 22 and the back seat bars 24 in their unfolded configuration.

Figure 30:
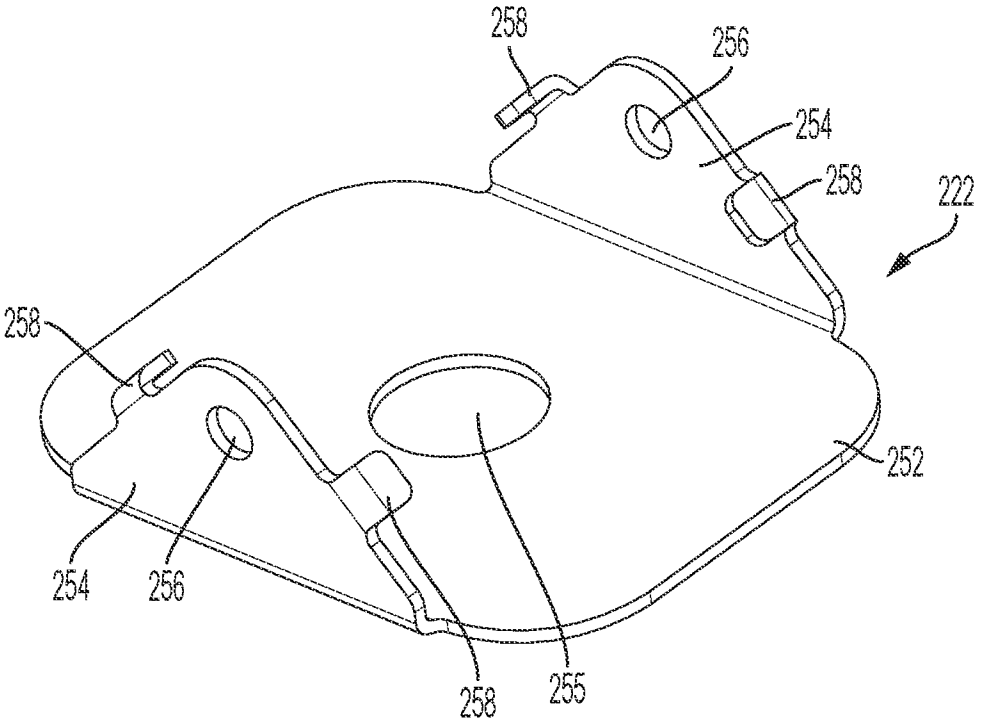
FIG. 30 is a top-perspective view of a lower plate of the center shaft assembly of the chair shown in FIGS. 23A-29.

Referring to FIG. 30, the lower plate 222 has a substantially planar major portion 252; and two substantially triangular flanges 254 that adjoin, and extend upward from opposite ends of the major portion 252. The major portion 252 and the flanges 254 are unitarily formed; the major portion 252 and the flanges 254 can be formed separately, and can be connected by a suitable means such as welding in alternative embodiments. The major portion 252 has a centrally located hole 255 formed therein. Each flange 254 has a centrally located hole 256 formed therein. Each flange 254 also includes two tabs 258 the extend inward, i.e., toward the opposite flange 254, from the sides of the flange 254.

The upper plate 220 is rotatably coupled to the lower plate 222 by a pin 262. In particular, the flanges 254 of the lower plate 222 overlap the flanges 238 of the upper plate 220 as can be seen in FIG. 27, so that the holes 230 in the flanges 228 of the upper plate 220 align with the holes 256 in the flange 254. The aligned holes 230, 256 receive the pin 262, which is sized to fit within the holes 230, 256 with minimal clearance.

Because the upper plate 220 and the attached upper hub assembly 202 rotate about an axis coinciding with the axial centerline of the pin 262, and the pin 262 extends in a direction coinciding with the widthwise, or side to side, direction of the seating area provided by the upper hub assembly 202, the user can recline while sitting on the chair 200. The tabs 258 on the flanges 254 of the lower plate 222 act as stops that limit the movement of the upper plate 220, and the upper hub assembly 202, in relation to the lower hub assembly 204. In particular, the tabs 258 are positioned so that one of the tabs 258 on each flange 254 contacts a corresponding one of the flanges 228 on the upper plate 220 when the upper plate 220 is in a substantially level orientation in relation to the lower plate 222, as shown in FIG. 27. The resulting interference between the tabs 258 and the flanges 228 limits tilting of the upper plate 222 and the upper hub assembly 202 in the forward direction, i.e., in the direction the user faces when sitting in the chair 200.

The other tab 258 on each flange 254 is positioned to contact, and interfere with rotation of the upper plate 220 as the upper plate 220 tilts or rotates rearward by, for example, about 13 degrees from its level orientation as depicted in 23B. Thus, the user can recline by, for example, up to about 13 degrees while sitting in the chair 200; and the user cannot tilt the upper hub assembly 202 forward, past its level orientation. The tabs 258 can be positioned to reclining movement of more, or less than 13 degrees, and/or to permit some degree of forward tilting, in alternative embodiments. Also, the tabs 258 can be positioned on the flanges 228 of the upper plate 220 in alternative embodiments.

Figure 31:
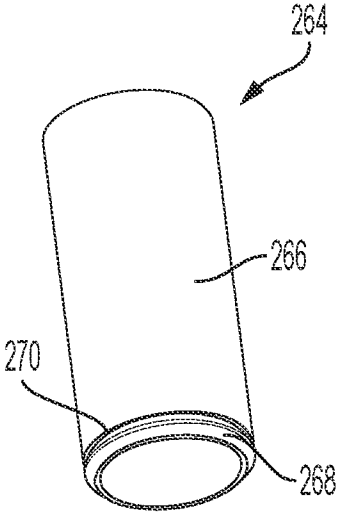
FIG. 31 is a bottom-perspective view of a center shaft of the center shaft assembly of the chair shown in FIGS. 23A-30.

The center shaft assembly 206 further includes a center shaft 264. Referring to FIG. 31, the center shaft 264 has a cylindrical body 266, a lower lip 268, and a recess 270 located between the body 266 and the lower lip 268. The lower lip 268 has an outer diameter about equal to the outer diameter of the body 266.

An upper end of the body 266 has an outer diameter slightly smaller than the diameter of the hole 255 in the major portion 252 of the lower plate 222. The upper end 267 is received in the hole 255, and is secured to the major portion 252 by a suitable means such as welding.

Figure 36:
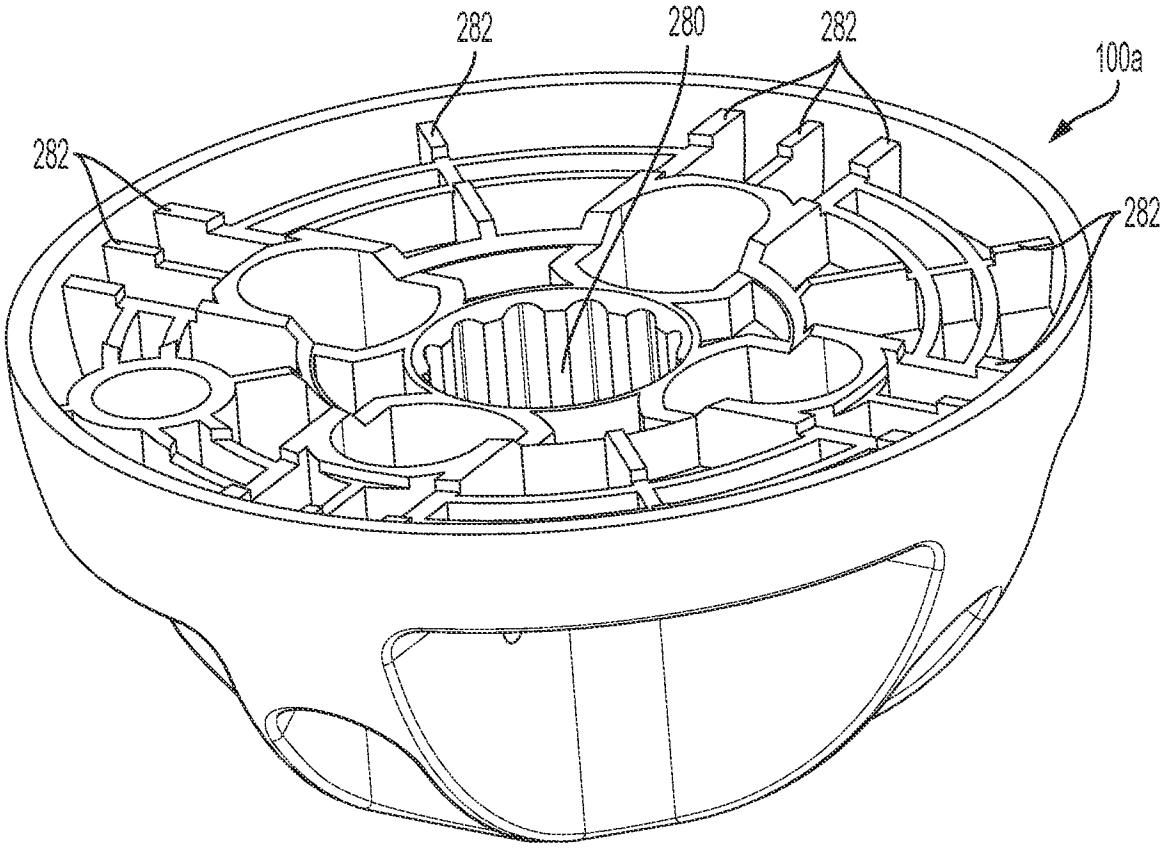
FIG. 36 is a top-perspective view of a lower hub of a lower hub assembly of the chair shown in FIGS. 23A-35.

Referring to FIGS. 28 and 36, the lower hub assembly 204 includes a lower hub 100*a*, and four legs 101 pivotally coupled to the lower hub 100*a*. The lower hub 100*a* is substantially similar to the lower hub 100 of the chair 10, with the exception that the lower hub 100*a* does not include any features to lock the upper hub assembly 202 in position in relation to the lower hub assembly 204.

The lower hub assembly 204 also includes two straps 288 that interconnect the legs 101*a* to help stabilize the chair 200 in its unfolded configuration. A buckle 286 is secured to each end of the straps 288. Each buckle 286 is secured to one of the legs 101*a* by way of holes formed in the leg 101*a*, so that the buckle 286 secures the end of the strap 288 to the leg 101*a*. Each of the straps 288 extends between, and interconnects two oppositely-positioned legs 100*a*, as shown in FIG. 28. The straps 288 help to limit the extent to which the legs 100*a* can rotate when the chair 200 is in its unfolded configuration, and thereby help to stabilize the chair 200.

The lower hub 100*a* has a cylindrical passage 280 formed therein, as shown in FIG. 36. The body 266 of the center shaft 264 of the center shaft assembly 204 is sized to fit within the passage 280 with minimal clearance between the outer surface of the body 266 and the adjacent surface of the hub 100*a*, so that the center shaft 264, and the attached lower plate 222, can rotate smoothly in relation to the lower hub 100*a*.

As can be seen in FIGS. 26-28, the lip 268 and the recess 270 protrude from the lower end of the hub 100*a* when the body 266 is positioned within the passage 280. The center shaft 264, and the attached lower plate 222, are restrained from upward movement in relation to the lower hub 100*a* by a clip 272 that is received in the recess 270.

Figure 24B:
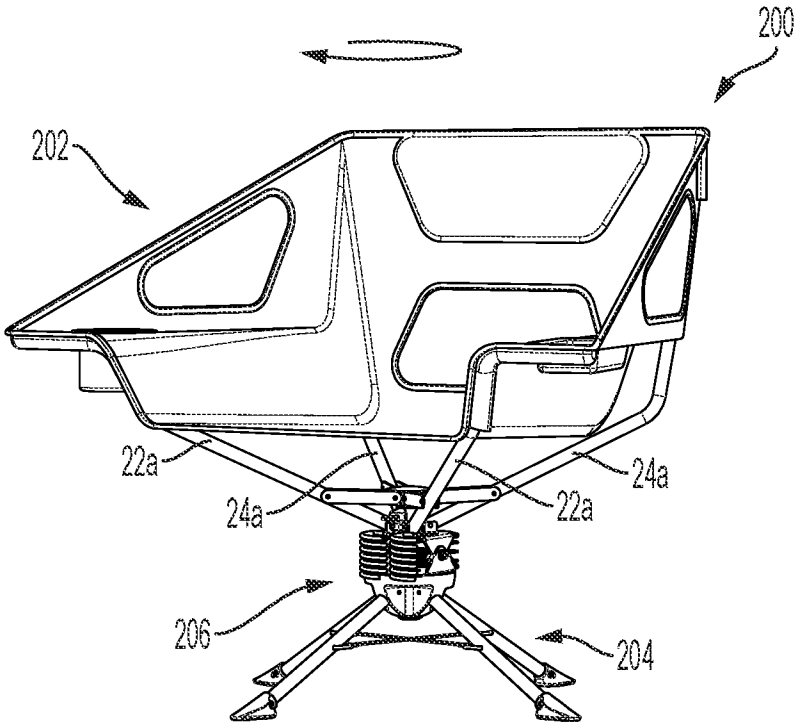
FIG. 24B is a perspective view of the chair shown in FIGS. 23A-24A, showing the chair in a level orientation and swiveled by about 45 degrees in relation to the orientation shown in FIG. 24A, and in an unfolded configuration.
Figure 24A:
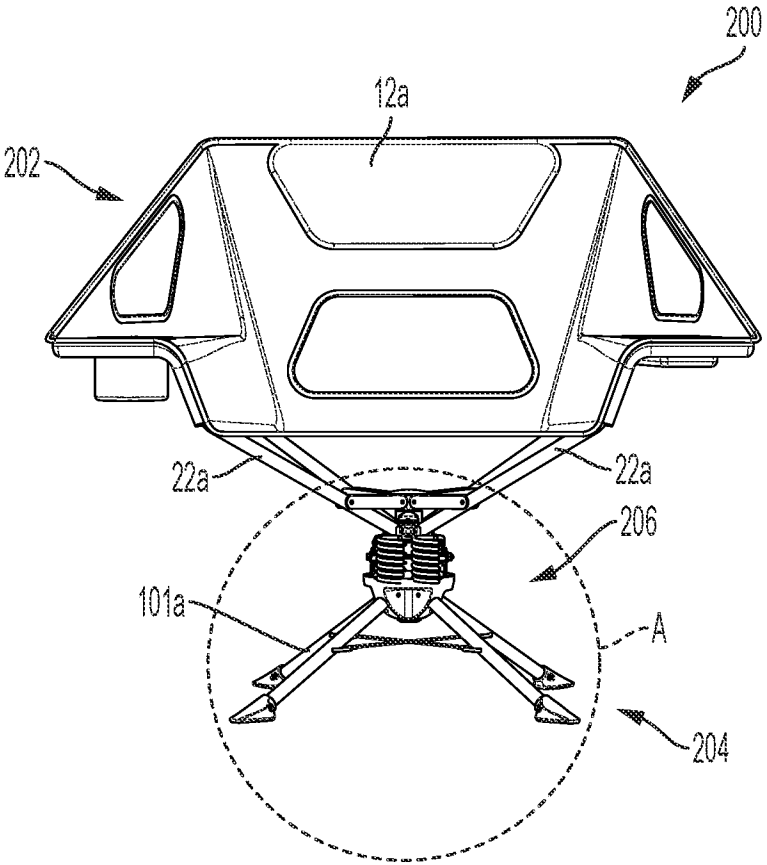
FIG. 24A is a front view of the chair shown in FIGS. 23A and 23B, showing the chair in a level orientation and an unfolded configuration.

The lower surface of the major portion 252 of the lower plate 222 rests on contact surfaces 282 of the lower hub 100*a*. The contact surfaces are shown in FIG. 36. The lower surface of the major portion 252 slides over the contact surfaces 282 as the lower plate 222 and the center shaft 264 rotate in relation to the lower hub 100*a*. This arrangement permits the center shaft assembly 206 and the attached upper hub assembly 202 to rotate or swivel by about 360 degrees in relation to the lower hub assembly 204 and the ground, which in turn allows the user to swivel the upper hub assembly 202 to the left and right without limitation, so that the user can face in any direction while seated in the chair 200. The swiveling motion of the chair 200 is depicted in FIGS. 24A and 24B.

The springs 224 are helical compression springs. The springs 225 are helical extension springs. The springs 224 and the springs 225 are positioned between the major portion 226 of the upper plate 220, and the major portion 252 of the lower plate 222, as can be seen in FIGS. 26-28. The upper end of each spring 224, 225 is secured to the upper plate 220 by a suitable means such as welding. The lower end of each spring 224, 225 is secured to the lower plate 222 by a suitable means such as welding. In alternative embodiments, the springs 224, 225 can be secured to the upper and lower plates 220, 222 by other means, such as hooked end portions that engage holes in the upper and lower plates 220, 222, brackets, fasteners, etc.

Each spring 224, 225 is oriented so that its axis extends substantially in the vertical direction when the chair 200 is positioned on level ground in its unfolded configuration. As can be seen in FIG. 27, the springs 274, 275 are spaced from the axial centerline of the pin 262, which coincides with the axis about which the upper plate 220 rotates in relation to the lower plate 222. The spring force generated by each spring 224, 225, therefore, produces a moment on the upper plate 220. Referring to FIG. 27, the extension springs 225 are positioned forward, or the left of the axial centerline of the pin 262; and the compression springs 224 are positioned rearward, or the right of the axial centerline of the pin 262.

The springs 224, 225 are configured so that the compression springs 224 are in a state of minimal compression; and the extension springs 225 are in a state of minimal extension when the upper hub assembly 202 is in a level orientation in relation to the lower hub assembly 204, as depicted in FIG. 27. Thus, the compression springs 224 exert an upward force on the upper plate 220; the extension springs 225 exert a downward force on the upper plate 220; the springs 224, 225 collectively exert a counterclockwise moment on the upper plate 220; and this moment biases the flanges 228 of upper plate 220 against the tabs 258 located on the forward side of the flanges 254 of the lower plate 222 when no outside forces are acting on the upper hub assembly 202 or the upper plate 220. The upper plate 220 and the upper hub assembly 202 thus remain in a level orientation, shown in FIGS. 23A and 27, when no outside forces are acting on the upper hub assembly 202 or the upper plate 220.

Figure 27A:
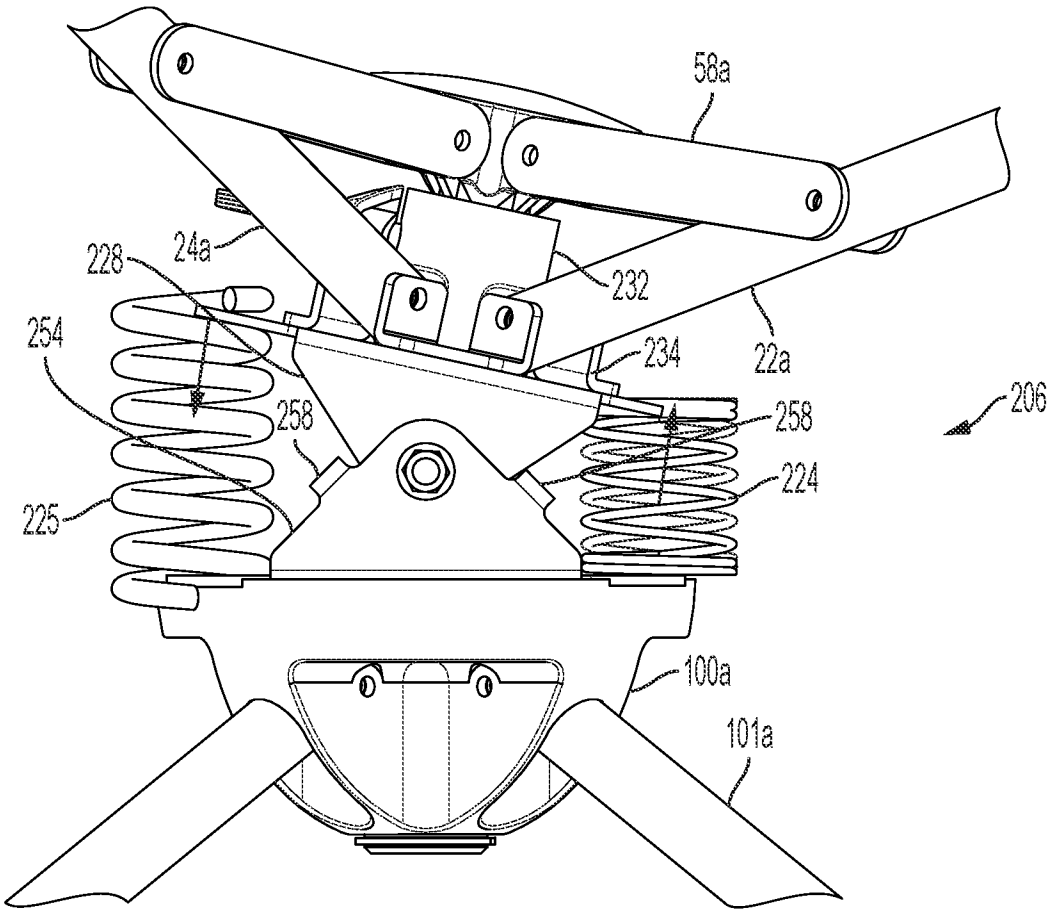
FIG. 27A is a magnified view of the area designated "A" in FIG. 24A, rotated by about 90 degrees from the perspective of FIG. 24A and showing the chair in the reclined orientation.

Referring to FIG. 27A, the springs 224, 225 exert additional bias on the upper plate 220 and the upper hub assembly 202 in the forward, or counterclockwise direction when the user, seated in the seating area provided by the upper hub assembly 202, reclines or tilts the upper hub assembly 202 away from its level orientation. In particular, the compression springs 224 undergo further compression when the user tilts the upper hub assembly 202 rearward from its level orientation. The extension springs 225 likewise undergo further extension when the user tilts the upper hub assembly 202 rearward. The additional compression and extension of the respective springs 224, 225 increases the spring force generated by the springs 224, 225, which in turn increases the counterclockwise moment exerted by the springs 224, 275 on the upper plate 220. The springs 224, 225 thus resist the rearward tilting of the upper hub assembly 202, with the resistance increasing as the user tilts the upper sub assembly 202 further from its level orientation. The springs 224, 225 thereby exert a stabilizing effect on the tilting motion of the upper hub assembly 202, and help to lessen or eliminate any shock or jarring to the user as the upper hub assembly 202 reaches its rearward stop. The springs 224, 225 also help to return the upper hub assembly 202 to its level orientation once the user stops urging the upper hub assembly 202 toward its reclined orientation.

The resistance of the springs 224, 225 to the tilting of the upper hub assembly 202, and the bias of the springs 224, 225 that helps restore the upper hub assembly 202 to its level orientation, are dependent upon the characteristics of the springs 224, 225, including the stiffness, or spring constants of the springs 224, 225. For example, the extension springs 224 can have a spring constant of about 22 pounds per inch; and the compression springs 225 can have a spring constant of about 190 pounds per inch. The springs 224, 225 of alternative embodiments can have different spring constants, and the relative magnitudes of the spring constants can vary from that disclosed herein. Also, the springs 224, 225 are depicted as having relatively small and large wire diameters, respectively, for illustrative purposes only. The relative sizes of the wire diameters can vary from that depicted in the figures.

FIGS. 37A-44 depict another alternative embodiment in the form of a chair 300. The chair 300 is substantially identical to the chair 200, with the exception that the chair 300 includes a center shaft assembly 206*a* comprising a torsion spring 302 in lieu of the compression springs 224 and extension springs 225 of the chair 200. Identical reference characters are used to refer to components of the chair 300 that are substantially identical to those of the chair 200.

Referring to FIGS. 39-42, the spring 302 is positioned between an upper plate 220*a* and a lower plate 222*a* of the center shaft assembly 206*a*. The spring 302 is configured as a double torsion spring. The spring 302 includes two substantially identical coils 304, and a middle portion 306 that adjoins, and connect the coils 304. Alternative embodiments can include one or more single torsion springs in lieu of the double torsion spring 302.

Figure 40:
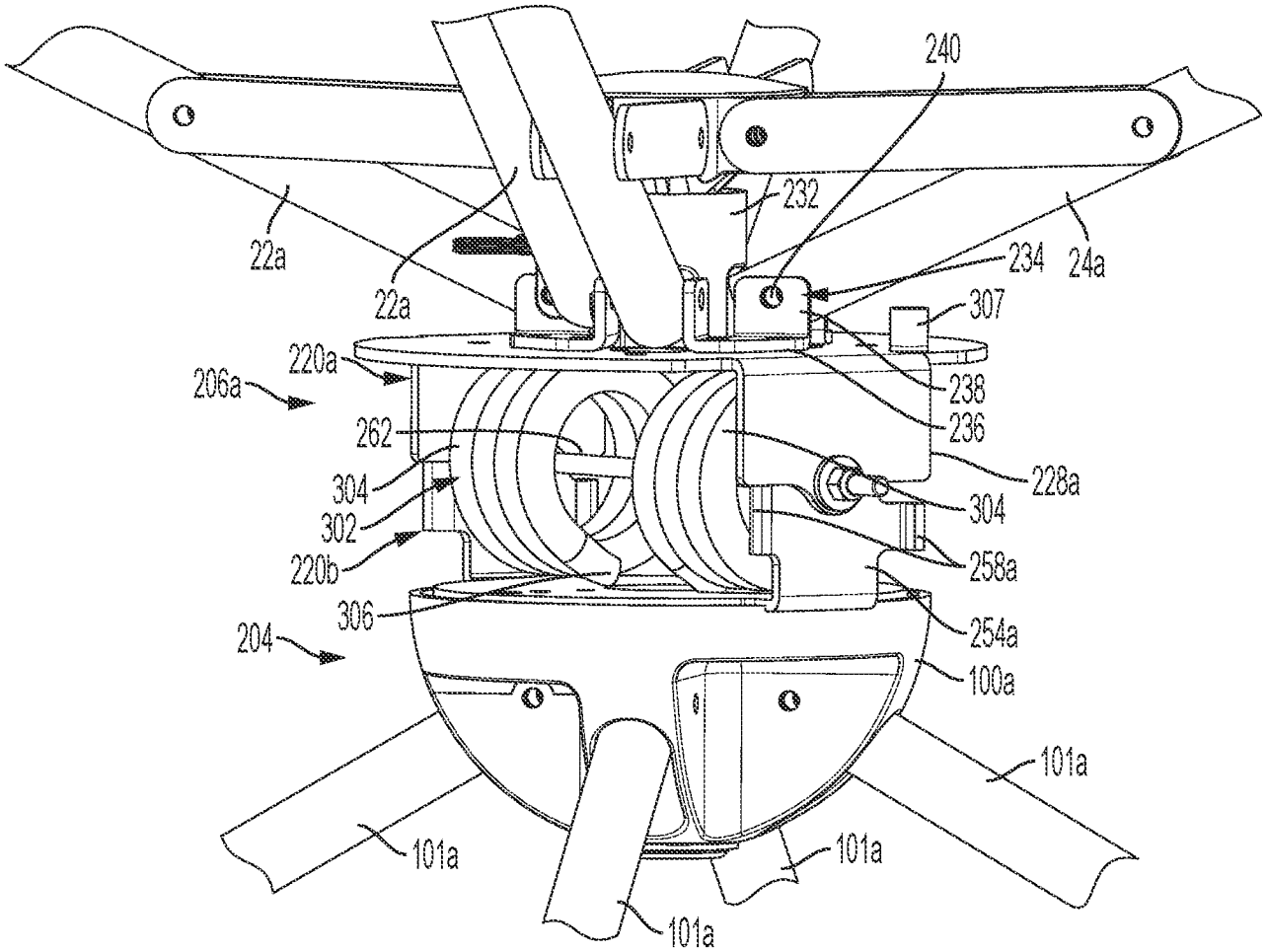
FIG. 40 is a magnified view of the area designated "B" in FIG. 38A, rotated by about 45 degrees from the perspective of FIG.
Figure 41:
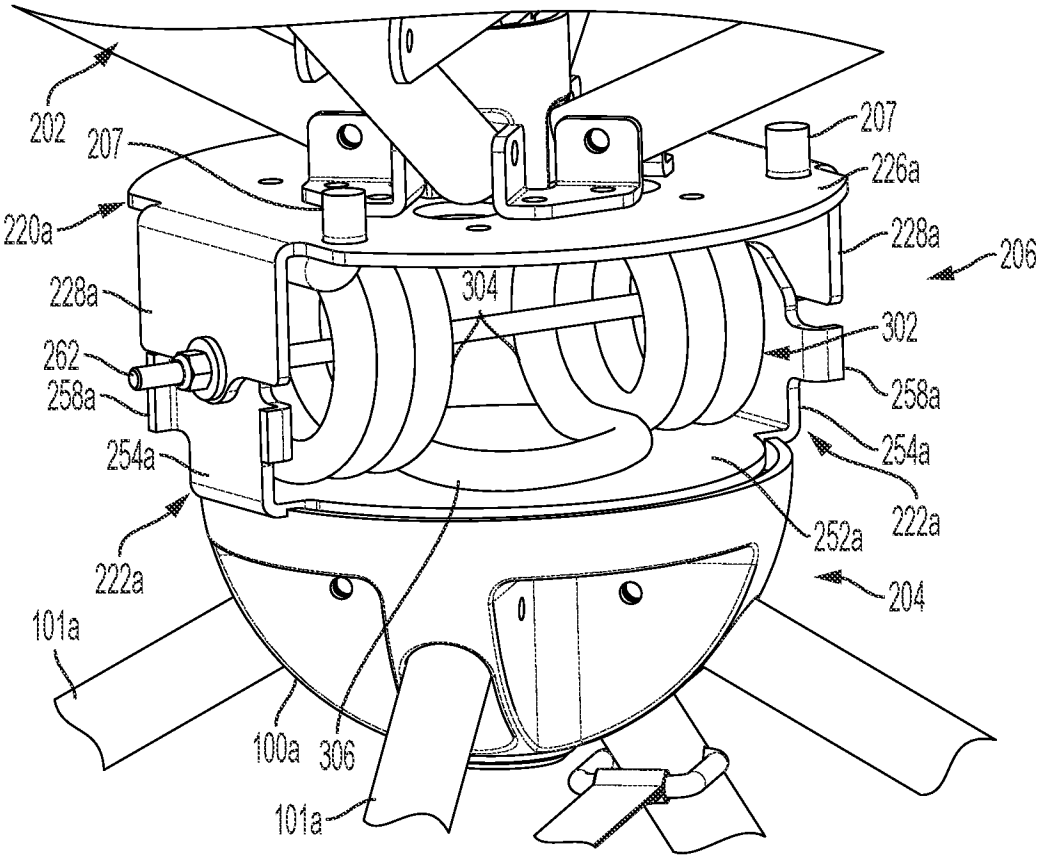
FIG. 41 is a top perspective view of the area designated "B" in FIG. 38A, rotated by about 45 degrees from the perspective of FIG. 38A
Figure 42:
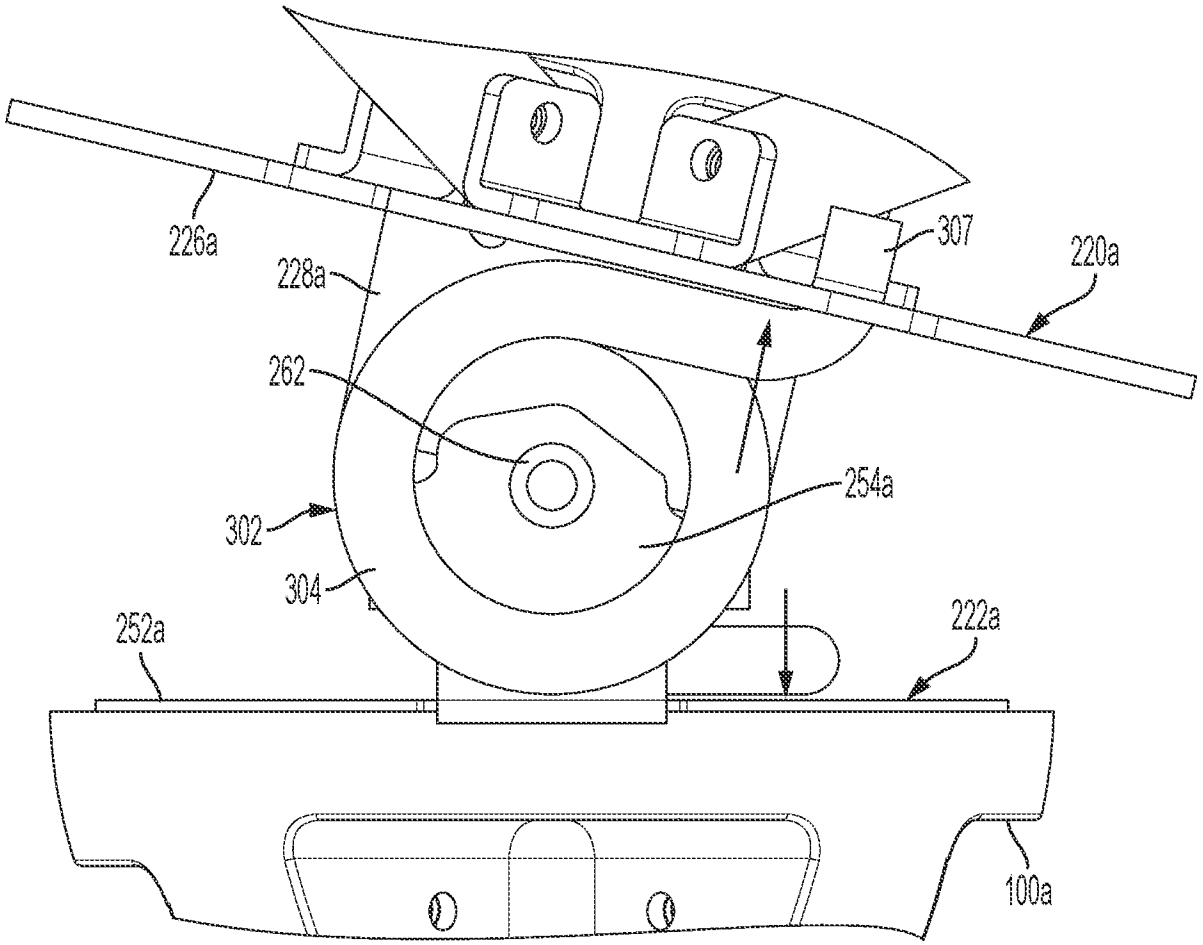
FIG. 42 is a magnified view of the area designated "B" in FIG. 38A, rotated by about 90 degrees from the perspective of FIG. 38A and depicting the chair in the reclined orientation.
Figure 43:
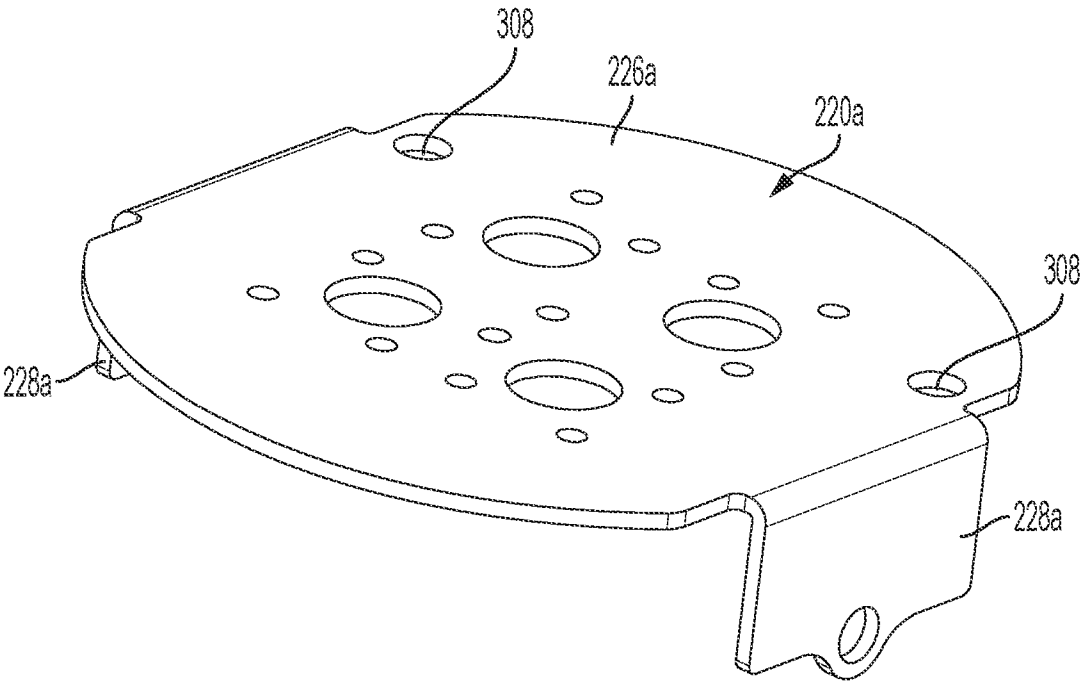
FIG. 43 is a top-perspective view of an upper plate of a center shaft assembly of the chair shown in FIGS. 37A-42.

The ends 307 of the spring 302 are connected the upper plate 220*a* via respective holes 308 formed in a major portion 226*a* of the upper plate 220*a*. The holes 308 are visible in FIG. 43. The middle portion 306 rest on, and is constrained from vertical movement by a major portion 252*a* of the lower plate 222*a*, as shown in FIG. 41. As can be seen in FIGS. 40-42, the spring 302 is oriented so that the center axis of the spring 302, i.e., the axis about which the spring 302 is wound, is approximately coincident with the axis about which the upper plate 220*a* pivots in relation to the lower plate 222*a*. The points of contact between the spring 302 and the respective upper and lower plates 220*a*, 222*a* are positioned so that the spring 302 exerts a moment on the upper plate 220*a* that biases the upper plate 220*a* toward the forward direction of rotation, i.e., toward the direction the user faces when sitting in the chair 300, and counterclockwise from the perspectives of FIGS. 37A, 37B, and 42. The spring 302 is configured so that the spring 302 constantly exerts its forward bias on the upper plate 220*a* throughout the entire range of travel of the upper plate 220*a* in relation to the lower plate 222*a*.

Figure 37B:
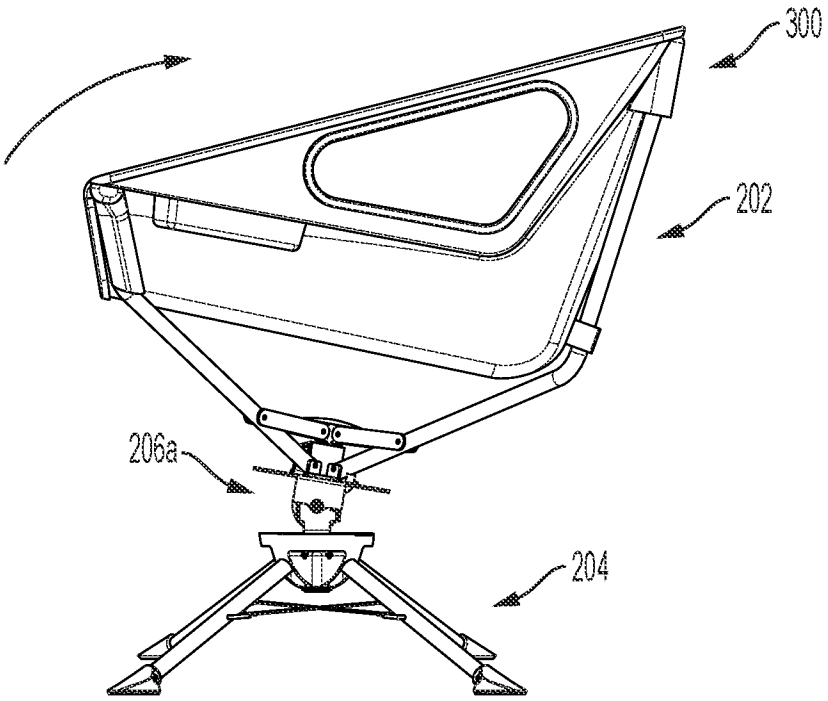
FIG. 37B is a side view of the chair shown in FIG. 37A, showing the chair in a reclined orientation and an unfolded configuration.
Figure 37A:
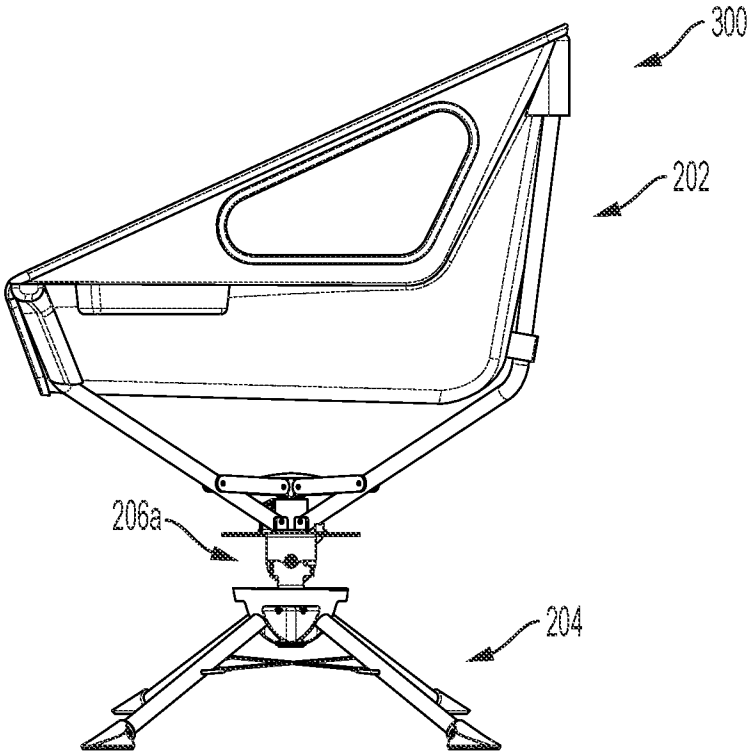
FIG. 37A is a side view of an alternative embodiment of the chair shown in FIGS. 23A-36, showing the chair in a level orientation and an unfolded configuration.
Figure 44:
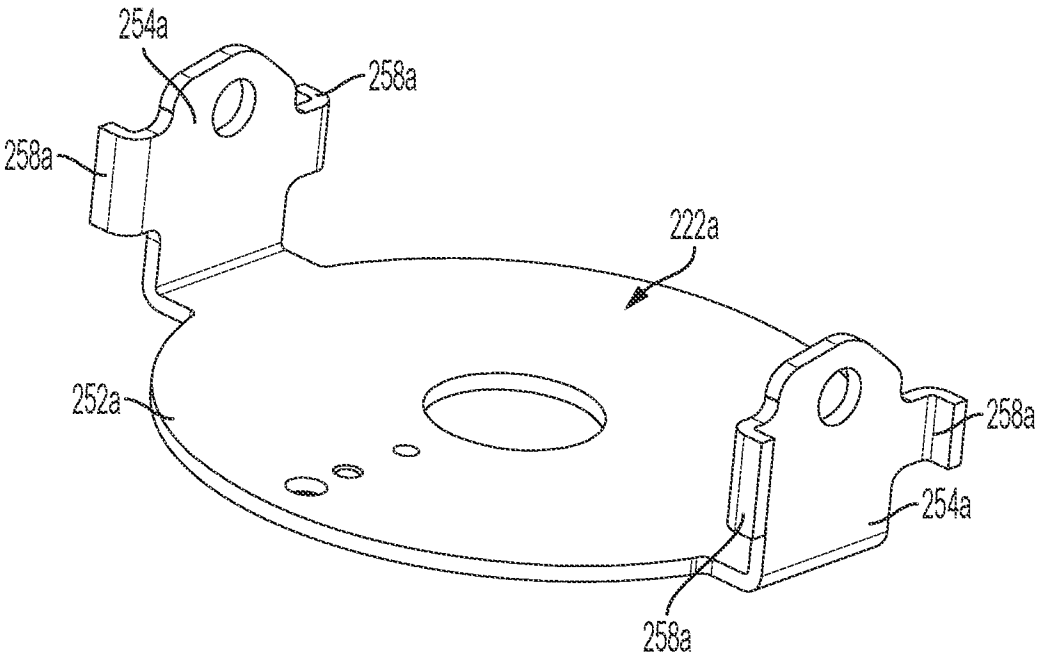
FIG. 44 is a top-perspective view of a lower plate of the center shaft assembly of the chair shown in FIGS. 37A-43.

Referring to FIG. 44, the lower plate 222*a* has two flanges 254*a* that extend from opposite sides of the major portion 252*a* of the lower plate 222*a*. Each flange 254*a* has two tabs 258*a* extending therefrom. The tabs 258*a* act as stops that limit the movement of the upper plate 220*a*, and the upper hub assembly 202, in relation to the lower hub assembly 204. In particular, the tabs 258*a* are positioned so that one of the tabs 258*a* on each flange 254*a* contacts a corresponding one of the flanges 228*a* on the upper plate 220*a* when the upper plate 220*a* is in a substantially level orientation in relation to the lower plate 222*a*, as depicted in FIGS. 37A, 38A, 38B, and 39-41. The resulting interference between the tabs 258*a* and the flanges 228*a* limits tilting of the upper plate 222*a* and the upper hub assembly 202 in the forward direction. The other tab 258*a* on each flange 254*a* is positioned to contact, and interfere with rotation of the upper plate 220*a* as the upper plate 220*a* tilts or rotates rearward by, for example, about 13 degrees from its level orientation, as depicted in FIGS. 37B and 42. Thus, the user can recline by, for example, up to about 13 degrees while sitting in the chair 300; and the user cannot tilt the upper hub assembly 202 forward, past its level orientation. The tabs 258*a* can be positioned to permit more, or less than 13 degrees of reclining movement, and/or to permit some degree of forward tilting, in alternative embodiments. Also, the tabs 258*a* can be positioned on the flanges 228*a* of the upper plate 220*a* in alternative embodiments. The spring 302 has a spring constant of, for example, about 53 pounds per degree. Torsion springs having a different spring constant can be used in alternative embodiments.

The spring 302 biases the upper plate 220*a* and the upper hub assembly 202 in the forward direction when the user reclines. In particular, the spring 302 undergoes further winding when the user tilts the upper hub assembly 202 from its level orientation to an inclined orientation. The additional winding of the spring 302 causes the spring 302 to resist the rearward tilting, with the resistance increasing as the user tilts the upper hub assembly 202 further from its level orientation. The spring 302 thus exerts a stabilizing effect on the tilting motion of the upper hub assembly 202, and helps to lessen or eliminate any shock or jarring to the user as the upper hub assembly 202 reaches its rearward stop. The spring 302 also helps to return the upper hub assembly 202 to its level orientation once the user ceases to urge the upper hub assembly 202 toward its reclining orientation.

Figure 38B:
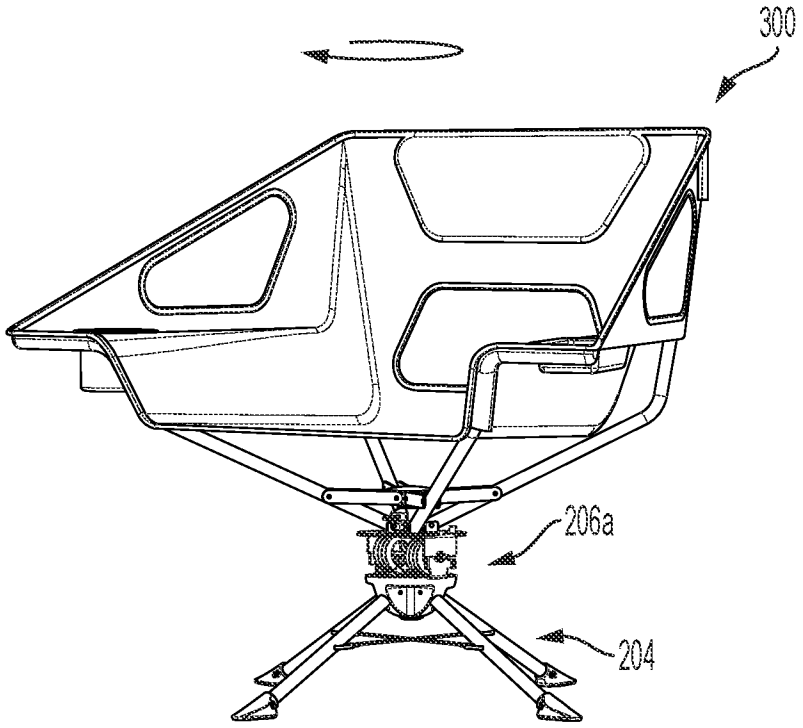
FIG. 38B is a perspective view of the chair shown in FIGS. 37A-38A, showing the chair in a level orientation and swiveled by about 45 degrees in relation to the orientation shown in FIG. 38A, and in an unfolded configuration.
Figure 38A:
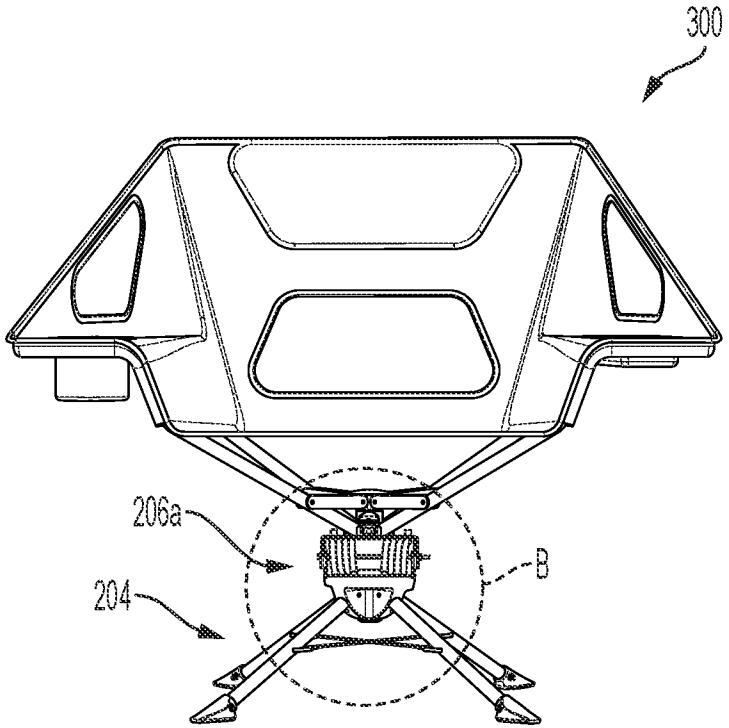
FIG. 38A is a front view of the chair shown in FIGS. 37A and 37B, showing the chair in a level orientation and an unfolded configuration.
Figure 39:
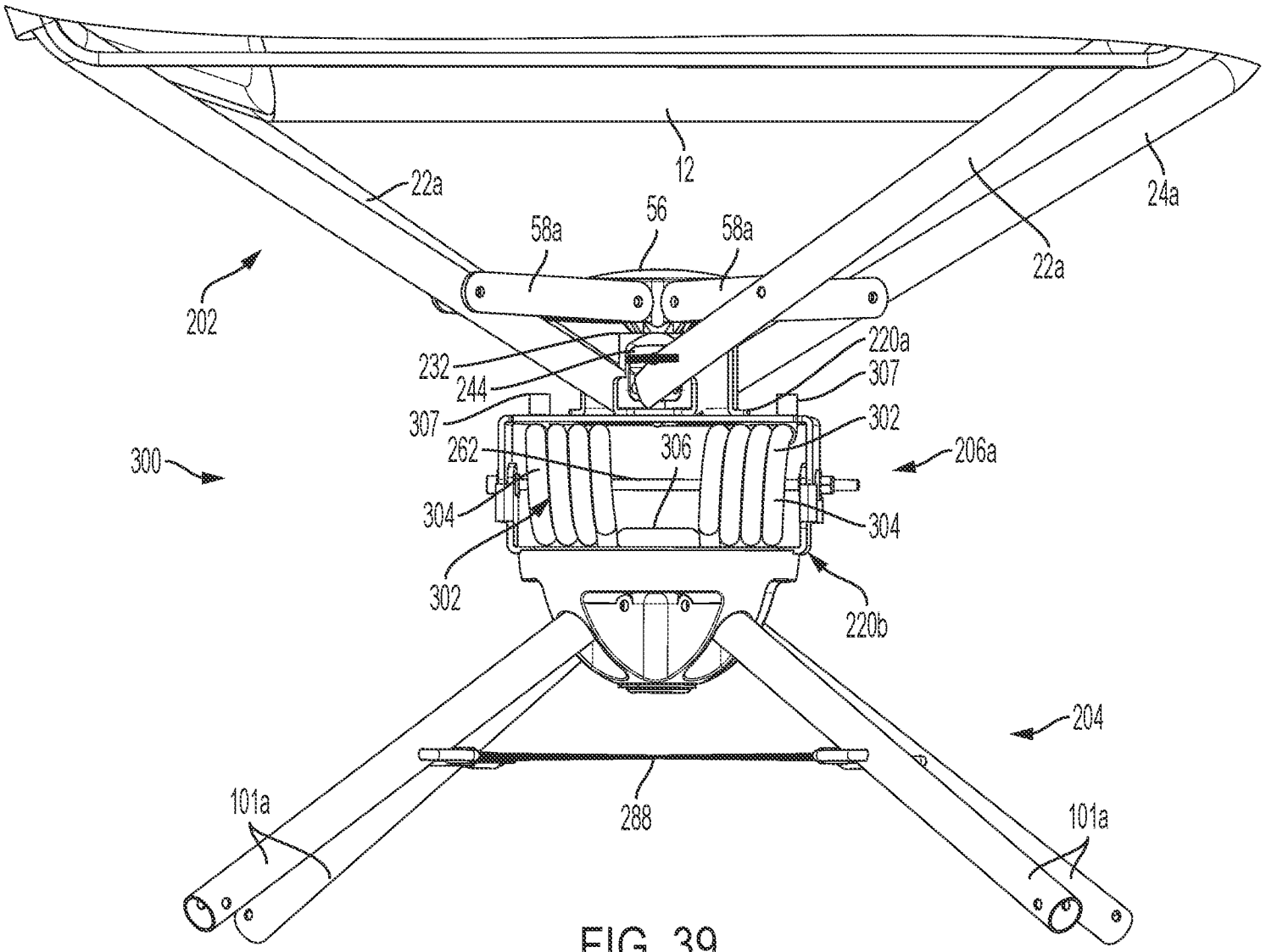
FIG. 39 is a magnified view of the area designated "B" in FIG. 38A.

Referring to FIGS. 38A and 38B, the center shaft assembly 206*a* and the attached upper hub assembly 202 can rotate or swivel by about 360 degrees in relation to the lower hub assembly 204 and the ground, which in turn allows the user to swivel the upper hub assembly 202 to the left and right without limitation, so that the user can face in any direction while seated in the chair 300.

The features and functions described above, as well as alternatives, may be combined into many other different systems or applications. Various alternatives, modifications, variations or improvements may be made by those skilled in the art, each of which is also intended to be encompassed by the disclosed embodiments.

What is claimed is:

1. A foldable chair comprising:
a lower hub assembly comprising:
a lower hub, and
a plurality of legs coupled to the lower hub and configured to rotate in relation to the lower hub;
a center shaft assembly mounted on the lower hub;
an upper hub assembly comprising:
an upper hub coupled to the center shaft assembly and configured to rotate in relation to the lower hub, and
a plurality of bars coupled to the upper hub and configured to rotate in relation to the upper hub;
a center support coupled to the plurality of bars and separated from the center shaft assembly; and
a webbing mounted on the bars, wherein the webbing is configured to fold and unfold as the bars rotate in relation to the upper hub, and to form a seating area when the webbing is unfolded.

2. The foldable chair of claim 1, wherein:
the center shaft assembly comprises a first plate, and a shaft secured to the first plate;
the lower hub has a passage formed therein; and
the shaft is positioned in the passage.

3. The foldable chair of claim 2, wherein the lower hub comprises a contact surface, and the first plate is configured to slide on the contact surface as the upper hub rotates in relation to the lower hub.

4. The foldable chair of claim 2, wherein:
the center shaft assembly further comprises a second plate coupled to the first plate and configured to rotate in relation to the first plate; and
the upper hub assembly is mounted on the second plate.

5. The foldable chair of claim 4, wherein the center shaft assembly further comprises a spring positioned between the first plate and the second plate.

6. The foldable chair of claim 5, wherein:
the second plate is configured to rotate between a first and a second angular position in relation to the first plate; and
the spring is configured to bias the second plate toward the first angular position.

7. The foldable chair of claim 6, wherein the seating area is substantially level in relation to the ground when the second plate is in the first angular position and the legs of the lower hub assembly are resting on the ground.

8. The foldable chair of claim 7, wherein:
the first plate comprises a substantially planar major portion, and two flanges that adjoin, and extend from the major portion;
the second plate comprises a substantially planar major portion, and two flanges that adjoin, and extend from the major portion of the second plate; and
the center shaft assembly further comprises a pin extending through the flanges of the first and scone plates; and
the pin is configured to couple the first and second plates.

9. The foldable chair of claim 8, wherein:
the first or the second plate further comprises tabs extend from the flanges of the first or the second plate; and
the tabs are configured limit the rotation of the second plate in relation to the first plate.

10. The foldable chair of claim 9, wherein the tabs are further configured to limit the rotation of the second plate in relation to the first plate to rotation of the second plate between the first and the second angular positions of the second plate.

11. The foldable chair of claim 6, wherein:
the spring is a first spring;
the center shaft assembly further comprises a second spring positioned between the first and second plates;
the first spring is a compression spring;
the second spring is an extension spring; and the second spring is configured to bias the second plate toward the first angular position.

12. The foldable chair of claim 11, wherein:

the second plate is configured to rotate in relation to the first plate about an axis of rotation; and the first and second springs are positioned on opposite sides of the axis of rotation.

13. The foldable chair of claim 6, wherein the spring is a torsion spring.

14. The foldable chair of claim 13, wherein:

the second plate is configured to rotate in relation to the first plate about an axis of rotation; and a center axis of the torsion spring is substantially coincident with the axis of rotation.

15. The foldable chair of claim 4, wherein:

the center shaft assembly further comprises a plurality of u-plates mounted on the second plate; and each of the brackets is coupled to the second plate by way of a respective one of the u-plates.

16. The foldable chair of claim 1, wherein:

the upper hub assembly further comprises a plurality of links;

the upper hub comprises a cavity;

each of the links is coupled to, and is configured to rotate in relation to the center support and one of the bars;

the center support is configured to engage the cavity when the webbing is unfolded; and the center support and the links are further configured to restrain the upper hub assembly in relation to the cavity when the center support engages the cavity.

17. The foldable chair of claim 16, wherein the center shaft assembly further comprises a lock configured to secure the bars in an unfolded configuration.

18. The foldable chair of claim 17, wherein:

the center shaft assembly comprises a support lock;

the lock comprises a pin, and a pin housing;

the pin is configured to engage the body of the center support by way of holes in the pin housing, the support lock, and the body when the body is positioned in the cavity; and the pin is further configured to retain the body in the cavity when the pin engages the body.

19. The foldable chair of claim 1, wherein the center shaft assembly is configured to facilitate tilting and swiveling of the seating area in relation to the lower hub assembly.

* * * * *